US011510455B2

(12) United States Patent
Alexander et al.

(10) Patent No.: US 11,510,455 B2
(45) Date of Patent: Nov. 29, 2022

(54) SKATE OR OTHER FOOTWEAR

(71) Applicant: Bauer Hockey Ltd., Blainville (CA)

(72) Inventors: Garnet Alexander, Beaconsfield (CA); Marc Poirier, St-Constant (CA)

(73) Assignee: BAUER HOCKEY LLC, Exeter, NH (US)

( * ) Notice: Subject to any disclaimer, the term of this patent is extended or adjusted under 35 U.S.C. 154(b) by 8 days.

(21) Appl. No.: 17/013,327

(22) Filed: Sep. 4, 2020

(65) Prior Publication Data

US 2022/0071340 A1 Mar. 10, 2022

(51) Int. Cl.
*A43B 5/16* (2006.01)
*A63C 1/22* (2006.01)

(52) U.S. Cl.
CPC ..... *A43B 5/1658* (2013.01); *A43B 5/1683* (2013.01); *A63C 1/22* (2013.01)

(58) Field of Classification Search
CPC .... A63C 1/00; A63C 1/02; A63C 1/22; A63C 1/24; A63C 1/26; A63C 1/28; A43B 5/1625; A43B 5/1641; A43B 5/1658; A43B 5/1683
See application file for complete search history.

(56) References Cited

U.S. PATENT DOCUMENTS

2008/0296871 A1* 12/2008 Hsieh ..... A63C 1/26 280/607
2017/0368722 A1* 12/2017 Jacobsen ..... B32B 27/065

FOREIGN PATENT DOCUMENTS

EP 2342983 A1 * 7/2011 ..... A43B 5/0417
EP 2478789 A1 * 7/2012 ..... A43B 17/02
WO WO-9600512 A1 * 1/1996 ..... A43B 5/1641

* cited by examiner

*Primary Examiner* — Ted Kavanaugh

(57) ABSTRACT

A skate (e.g., an ice skate) or other footwear for a user, in which a skate boot or other foot-receiving structure for receiving a foot of the user may be configured to enhance power transfer of the user (e.g., for push-off and skating straight), agility of the user (e.g., for turns), and/or other aspects of performance of the user, such as by comprising a sole region that is configured to be disposed under the user's foot and includes different materials strategically distributed (e.g., in a longitudinal direction of the skate boot or other foot-receiving structure) or otherwise implements these enhancements.

36 Claims, 35 Drawing Sheets

SKATE OR OTHER FOOTWEAR

FIELD

The disclosure generally relates to footwear, such as skates for playing hockey or other skating activities, or other types of footwear.

BACKGROUND

Skates are used by users in various sports such as ice hockey or roller hockey and other activities. A skate comprises a skate boot above a skating device, such as a blade holder holding a blade or a chassis carrying wheels.

Many factors affect users' performance, comfort, etc. while skating. For example, this may include power transfer from a user's foot towards a skating surface (e.g., ice) and agility of the user to turn and perform other maneuvers. Sometimes, such factors may be conflicting or entail trade-offs.

Similar considerations may arise for other types of footwear (e.g., ski boots, snowboarding boots, motorcycle boots, work boots, shoes, etc.).

For these and/or other reasons, there is a need for improvements directed to skates and other footwear.

SUMMARY

In accordance with various aspects, this disclosure relates to a skate (e.g., an ice skate) or other footwear for a user, in which a skate boot or other foot-receiving structure for receiving a foot of the user may be configured to enhance power transfer of the user (e.g., for push-off and skating straight), agility of the user (e.g., for turns), and/or other aspects of performance of the user, such as by comprising a sole region that is configured to be disposed under the user's foot and includes different materials strategically distributed (e.g., in a longitudinal direction of the skate boot or other foot-receiving structure) or otherwise implements these enhancements.

For example, in accordance with one aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot. The sole comprises a plurality of materials that are different and positioned differently in a longitudinal direction of the sole.

In accordance with another aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot and comprising. The sole comprises a first material positioned in a front portion of the sole and configured to be beneath toes and a ball of the user's foot. The sole also comprises a second material positioned in a rear portion of the sole, configured to be disposed beneath the heel of the user's foot, and more resilient than the first material.

In accordance with another aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot. The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing the heel portion of the upper of the skate boot to move relative to the skating device while the user skates.

In accordance with another aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot. The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing the heel portion of the upper of the skate boot to move laterally relative to the skating device while the user skates.

In accordance with another aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot. The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing movement of the heel portion of the upper of the skate boot to move laterally relative to the skating device while the user skates. The movement of the heel portion of the upper of the skate boot relative to the skating device includes at least one of: rotation of the heel portion of the upper of the skate boot relative to the skating device about a longitudinal axis of the skate boot; and translation of the heel portion of the upper of the skate boot relative to the skating device in a widthwise direction of the skate boot.

In accordance with another aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot. The sole comprises a first material positioned in a front portion of the sole and configured to facilitate the user skating straight. The sole also comprises a second material different from the first material, positioned in a rear portion of the sole, and configured to facilitate the user turning.

In accordance with another aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot. The sole comprises a first material positioned in a front portion of the sole and configured to facilitate push-off and power transfer by the user while skating. The sole also comprises a second material different from the first material, positioned in a rear portion of the sole, and configured to facilitate turns by the user while skating.

In accordance with another aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot and comprising a stiff zone and a resilient zone that is positioned elsewhere than the stiff zone in a longitudinal direction of the sole. The stiff zone comprises a stiff material. The resilient zone comprises a resilient material more resilient than the stiff material.

In accordance with another aspect, this disclosure relates to a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot and comprising a power zone and an agility zone that is positioned elsewhere than the power zone in a longitudinal direction of the sole. The power zone comprises a first material. The agility zone comprises a second material more resilient than the first material.

In accordance with another aspect, this disclosure relates a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot. The sole comprises a stiff zone and a resilient zone that is positioned elsewhere than the stiff zone in a longitudinal direction of the sole. The stiff zone is configured to facilitate push-off and power transfer by the user while skating. The resilient zone is configured to facilitate turns by the user while skating.

In accordance with another aspect, this disclosure relates a skate boot for a user to skate. The skate boot is configured to receive a foot of the user above a skating device engaging a skating surface. The skate boot comprises an upper comprising a lateral side portion configured to face a lateral side of the user's foot, a medial side portion configured to face a medial side of the user's foot, a heel portion configured to face a heel of the user's foot, and an ankle portion configured to face an ankle of the user. The skate boot also comprises a sole configured to face a plantar surface of the user's foot. The sole comprises a power zone and an agility zone that is positioned elsewhere than the power zone in a longitudinal direction of the sole. The power zone is configured to facilitate push-off and power transfer by the user while skating. The agility zone is configured to facilitate turns by the user while skating.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user. The sole is configured to face a plantar surface of the user's foot. The sole comprises a plurality of materials that are different and positioned differently in a longitudinal direction of the sole.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user. The sole is configured to face a plantar surface of the user's foot. The sole comprises a first material positioned in a front portion of the sole and configured to be beneath toes and a ball of the user's foot. The sole also comprises a second material positioned in a rear portion of the sole, configured to be disposed beneath the heel of the user's foot, and more resilient than the first material.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user. The sole is configured to face a plantar surface of the user's foot.

The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing the heel portion of the upper of the skate boot to move relative to the skating device while the user skates.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user. The sole is configured to face a plantar surface of the user's foot. The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing the heel portion of the upper of the skate boot to move laterally relative to the skating device while the user skates.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user. The sole is configured to face a plantar surface of the user's foot. The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing movement of the heel portion of the upper of the skate boot to move laterally relative to the skating device while the user skates. The movement of the heel portion of the upper of the skate boot relative to the skating device includes at least one of: rotation of the heel portion of the upper of the skate boot relative to the skating device about a longitudinal axis of the skate boot; and translation of the heel portion of the upper of the skate boot relative to the skating device in a widthwise direction of the skate boot.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user, the sole being. The sole is configured to face a plantar surface of the user's foot. The sole comprises a first material positioned in a front portion of the sole and configured to facilitate the user skating straight. The sole also comprises a second material different from the first material, positioned in a rear portion of the sole, and configured to facilitate the user turning.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user. The sole is configured to face a plantar surface of the user's foot. The sole comprises a first material positioned in a front portion of the sole and configured to facilitate push-off and power transfer by the user while skating. The sole also comprises a second material different from the first material, positioned in a rear portion of the sole, and configured to facilitate turns by the user while skating.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user. The sole is configured to face a plantar surface of the user's foot. The sole comprises a stiff zone and a resilient zone that is positioned elsewhere than the stiff zone in a longitudinal direction of the sole. The stiff zone comprises a stiff material. The resilient zone comprises a resilient material more resilient than the stiff material.

In accordance with another aspect, this disclosure relates to a sole for a skate boot for a user to skate. The skate boot is configured to receive a foot of the user above a skating device engaging a skating surface. The skate boot comprises an upper that comprises a lateral side portion configured to face a lateral side of the user's foot, a medial side portion configured to face a medial side of the user's foot, a heel portion configured to face a heel of the user's foot, and an ankle portion configured to face an ankle of the user. The sole is configured to face a plantar surface of the user's foot. The sole comprises a power zone and an agility zone that is positioned elsewhere than the power zone in a longitudinal direction of the sole. The power zone comprises a first material. The agility zone comprises a second material more resilient than the first material.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a plurality of materials that are different and positioned differently in a longitudinal direction of the sole.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a first material positioned in a front portion of the sole and configured to be beneath toes and a ball of the user's foot. The sole also comprises a second material positioned in a rear portion of the sole, configured to be disposed beneath the heel of the user's foot, and more resilient than the first material.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing the heel portion of the upper of the footwear to move relative to an underlying component of the footwear below the sole while the user moves.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing the heel portion of the upper of the footwear to move laterally relative to an underlying component of the footwear below the sole while the user moves.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a first material positioned in a front portion of the sole and configured to be beneath toes and a ball of the user's foot. The sole also comprises a second material different from the first material, positioned in a rear portion of the sole, configured to be disposed beneath the heel of the user's foot, and configured to resiliently deform for allowing movement of the heel portion of the upper of the footwear to move laterally relative to an underlying component of the footwear below the sole. The movement of the heel portion of the upper of the footwear relative to the underlying component of the footwear includes at least one of: rotation of the heel portion of the upper of the footwear relative to the underlying component of the footwear about a longitudinal axis of the footwear; and translation of the heel portion of the upper of the footwear relative to the underlying component of the footwear in a widthwise direction of the footwear.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a first material positioned in a front portion of the sole and configured to facilitate the user skating straight. The sole also comprises a second material different from the first material, positioned in a rear portion of the sole, and configured to facilitate the user turning.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a first material positioned in a front portion of the sole and configured to facilitate push-off and power transfer by the user is moving. The sole also comprises a second material different from the first material, positioned in a rear portion of the sole, and configured to facilitate turns by the user while moving.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a stiff zone and a resilient zone that is positioned elsewhere than the stiff zone in a longitudinal direction of the sole. The stiff zone comprises a stiff material. The resilient zone comprises a resilient material more resilient than the stiff material.

In accordance with another aspect, this disclosure relates to footwear for a user. The footwear is configured to receive a foot of the user. The footwear comprises an upper comprising a lateral side portion configured to face a lateral side of the user's foot, a medial side portion configured to face a medial side of the user's foot, and a heel portion configured to face a heel of the user's foot. The footwear also comprises a sole configured to face a plantar surface of the user's foot. The sole comprises a power zone and an agility zone that is positioned elsewhere than the power zone in a longitudinal direction of the sole. The power zone comprises a first material. The agility zone comprises a second material more resilient than the first material.

These and other aspects of this disclosure will now become apparent to those of ordinary skill in the art upon review of a description of embodiments that follows in conjunction with accompanying drawings.

BRIEF DESCRIPTION OF DRAWINGS

A detailed description of embodiments is provided below, by way of example only, with reference to drawings annexed hereto, in which.

and

Figure 50:
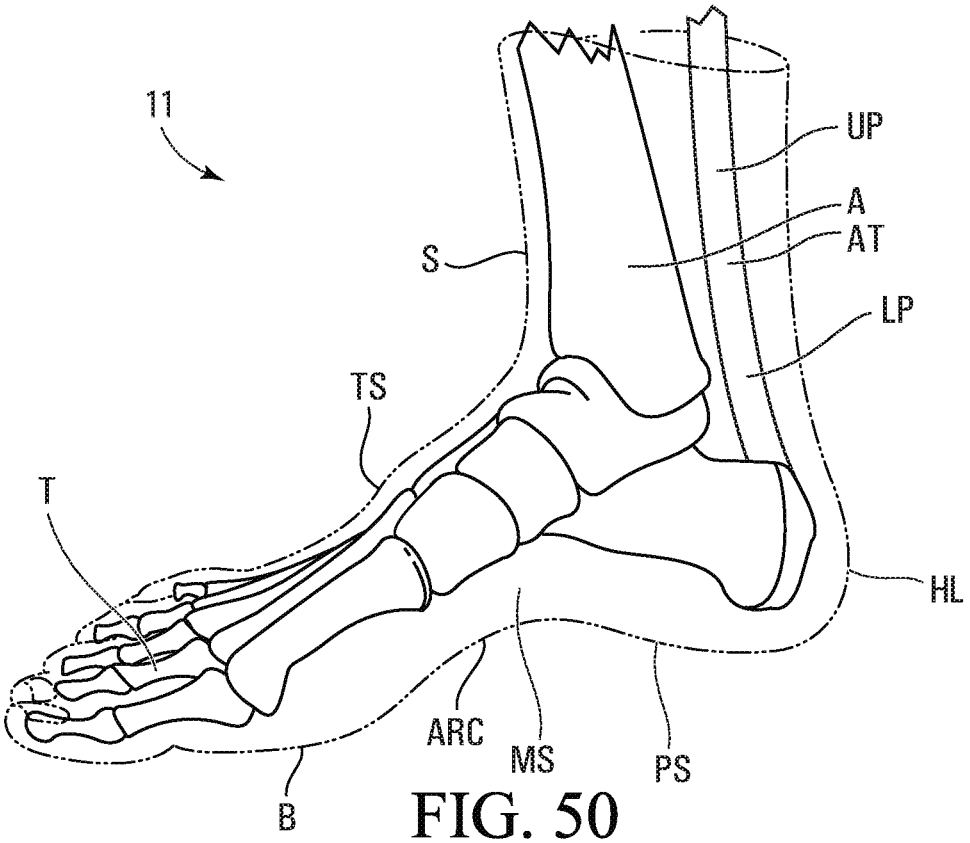
Figure 51:
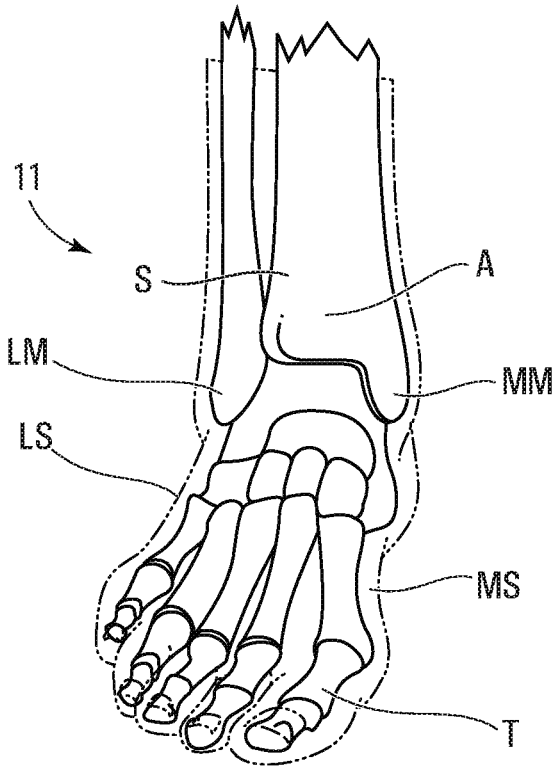

FIGS. 50 and 51 are side and front views of a foot of the user with an integument of the foot shown in dotted lines and bones shown in solid lines.

In the drawings, embodiments are illustrated by way of example. It is to be expressly understood that the description and drawings are only for purposes of illustration and as an aid to understanding and are not intended to be and should not be limitative.

DETAILED DESCRIPTION OF EMBODIMENTS

Figure 1:
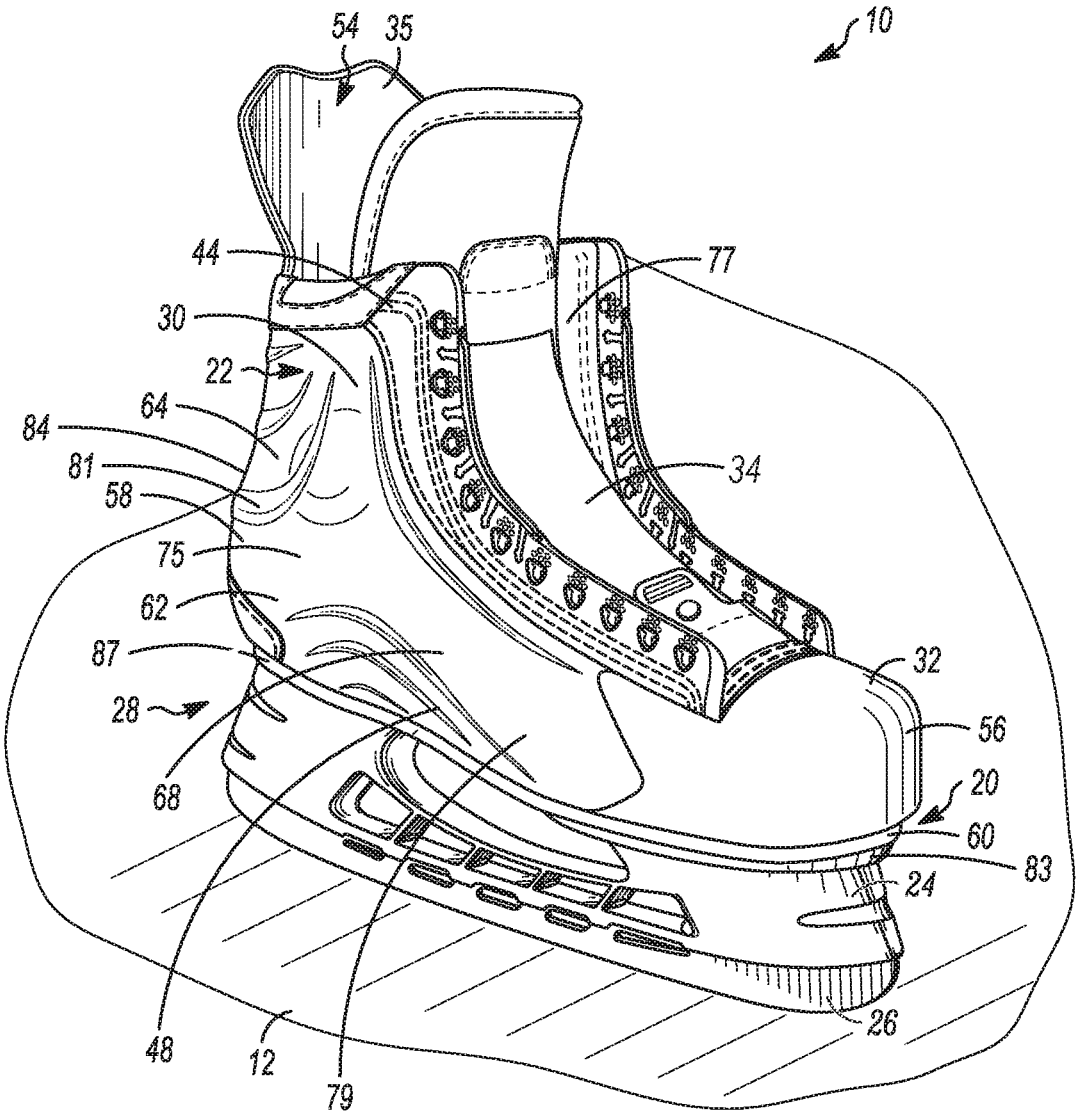
FIG. 1 is a perspective view of an embodiment of footwear for a user in which the footwear is a skate for the user who is playing hockey.
Figure 2:
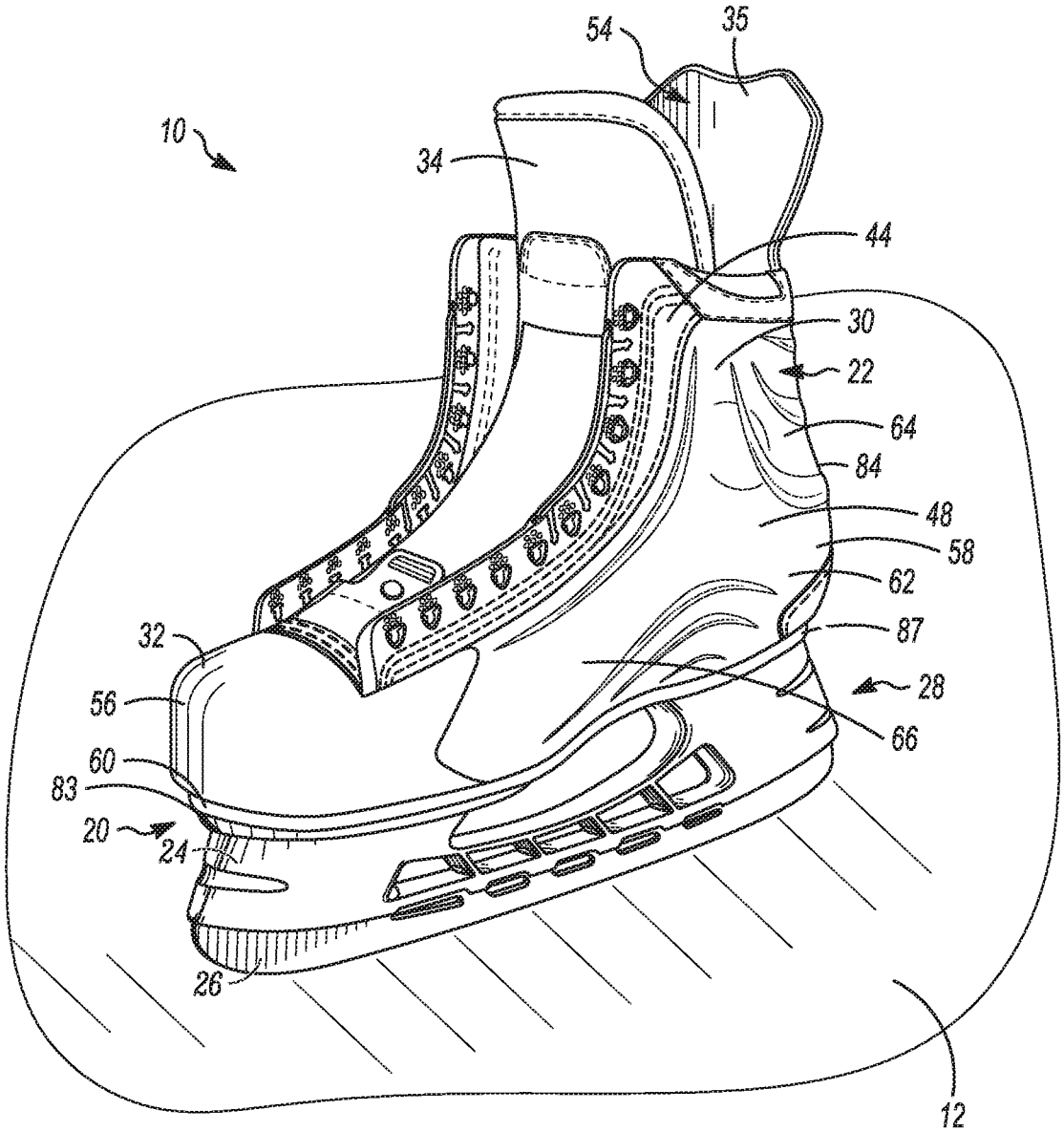
FIG. 2 is a second perspective view of the skate of FIG. 1.
Figure 3:
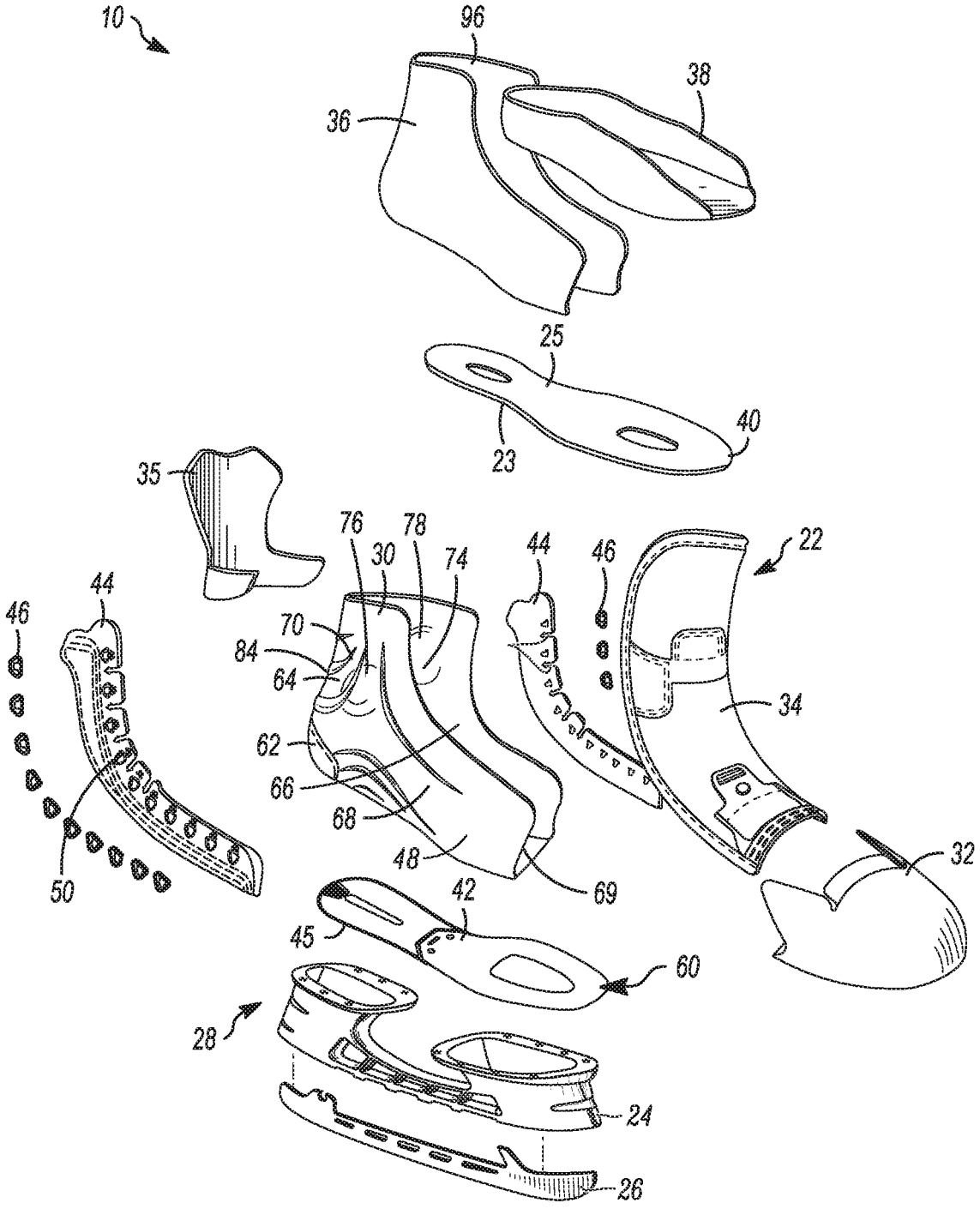
FIG. 3 is an exploded perspective view of the skate of FIG. 1.

FIGS. 1, 2 and 3 show an embodiment of footwear 10 for a user. In this embodiment, the footwear 10 is a skate for the user to skate on a skating surface 12. More particularly, in this embodiment, the skate 10 is a hockey skate for the user who is a hockey user playing hockey. In this example, the skate 10 is an ice skate, a type of hockey played is ice hockey, and the skating surface 12 is ice.

The skate 10 comprises a skate boot 22 for receiving a foot 11 of the user and a skating device 28 below the skate boot 22 to engage the skating surface 12. In this embodiment, the skating device 28 comprises a blade 26 for contacting the ice 12 and a blade holder 24 between the skate boot 22 and the blade 26. Each of the skate 10, the skate boot 22, and the skating device 28 has a longitudinal direction, a widthwise (i.e., lateral) direction, and a heightwise direction.

In this embodiment, as further discussed below, the skate boot 22 is configured to enhance power transfer of the user (e.g., for push-off and skating straight), agility of the user (e.g., for turns), and/or other aspects of performance of the user, such as by comprising a sole region 20 that is configured to be disposed under the user's foot 11 and includes different materials strategically distributed (e.g., in the longitudinal direction of the skate boot 22) or otherwise implements these enhancements.

The skate boot 22 is a foot-receiving structure defining a cavity 54 for receiving the user's foot 11. With additional reference to FIGS. 50 and 51, the user's foot 11 includes toes T, a ball B, an arch ARC, a plantar surface PS, a top surface TS, a medial side MS, and a lateral side LS. The top surface TS of the user's foot 11 is continuous with a lower portion of a shin S of the user. In addition, the user has a heel HL, an Achilles tendon AT, and an ankle A having a medial malleolus MM and a lateral malleolus LM that is at a lower position than the medial malleolus MM. The Achilles tendon AT has an upper part UP and a lower part LP projecting outwardly with relation to the upper part UP and merging with the heel HL. A forefoot of the user includes the toes T and the ball B, a hindfoot of the user includes the heel HL, and a midfoot of the user is between the forefoot and the hindfoot.

More particularly, in this embodiment, the skate boot 22 comprises a body 30, a toe cap 32, a tongue 34, a tendon guard 35, a liner 36, a footbed 38, and soles 40, 60. In this example, the soles 40, 60 are part of the sole region 20 of the skate boot 22 that is configured to face the plantar surface PS of the user's foot 11, in which the sole 40 is an insole disposed inside the cavity 54 of the skate boot 22 and the sole 60 is an outsole disposed outside the cavity 54 of the skate boot 22 to interface with the blade holder 24. The skate boot 22 also comprises lace members 44 and eyelets 46 extending through (e.g., punched into) the lace members 44, the body 30 and the liner 36 vis-à-vis apertures 50 in order to receive a lace for tying on the skate 10.

The body 30 of the skate boot 22, which may be referred to as a "shell", imparts strength and structural integrity to the skate 10 to support the user's foot 11. More particularly, in this embodiment, the shell 30 of the skate boot 22 comprises an upper 48 disposed above the sole region 20 of the skate boot 22 and comprising medial and lateral side portions 66, 68 configured to respectively face the medial and lateral sides MS, LS of the user's foot 11, a heel portion 62 configured to receive the heel HL of the user, and an ankle portion 64 configured to receive the ankle A of the user. Also, in this embodiment, the shell 30 of the skate boot 22 comprises a sole portion 69 that is part of the sole region 20 of the skate boot 22 and configured to face the plantar surface PS of the user's foot 11. The shell 30 thus includes a quarter 75 which comprises a medial quarter part 77, a lateral quarter part 79, and a heel counter 81. The heel portion 62 may be formed such that it is substantially cup-shaped for following the contour of the heel HL of the user. The ankle portion 64 comprises medial and lateral ankle sides 74, 76. The medial ankle side 74 has a medial depression 78 for receiving the medial malleolus MM of the user and the lateral ankle side 76 has a lateral depression 70 for receiving the lateral malleolus LM of the user. The lateral depression 70 is located slightly lower than the medial depression 78 for conforming to the morphology of the user's foot 11. The ankle portion 64 further comprises a rear portion 84 facing the lower part LP of the Achilles tendon AT of the user.

In this embodiment, the shell 30 of the skate boot 22 is molded to form its medial and lateral side portions 66, 68, its ankle portion 64, its heel portion 62, and its sole portion 69. For example, in some embodiments, the shell 30 may be thermoformed (e.g., onto a male form, i.e., a last) to form its medial and lateral side portions 66, 68, its ankle portion 64, its heel portion 62, and its sole portion 69. As another example, in some embodiments, at least part of the shell 30 may be injection molded such that two or more of its medial and lateral side portions 66, 68, its ankle portion 64, its heel portion 62, and its sole portion 69 are injection molded together and integral with one another (i.e., are injection molded together as a single piece). For instance, in some embodiments, the shell 30 may be a monolithic body, i.e., a one-piece body, made by injection molding.

The shell 30 of the skate boot 22 may include one or more materials. For example, in some embodiments, the shell 30 may include one or more polymeric materials, such as polyethylene, polypropylene, polyurethane (PU), ethylene-vinyl acetate (EVA), nylon, polyester, vinyl, polyvinyl chloride, polycarbonate, an ionomer resin (e.g., Surlyn®), styrene-butadiene copolymer (e.g., K-Resin®) etc.), self-reinforced polypropylene composite (e.g., Curv®), and/or any other thermoplastic or thermosetting polymer. Alternatively or additionally, in some embodiments, the shell 30 may include one or more composite materials, such as a fiber-matrix composite material comprising fibers disposed in a matrix. For instance, in some embodiments, the body 30 may include a fiber-reinforced plastic (FRP—a.k.a., fiber-reinforced polymer), comprising a polymeric matrix may include any suitable polymeric resin, such as a thermoplastic or thermosetting resin, like epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, polyester, vinyl ester, vinyl ether, polyurethane, cyanate ester, phenolic resin, etc., a hybrid thermosetting-thermoplastic resin, or any other suitable resin, and fibers such as carbon fibers, glass fibers, polymeric fibers such as aramid fibers (e.g., Kevlar fibers), boron fibers, silicon carbide fibers, metallic fibers, ceramic fibers, etc., which may be provided as layers of continuous fibers (e.g. pre-preg (i.e., pre-impregnated) layers of fibers held together by an amount of matrix).

The inner liner 36 of the skate boot 22 is affixed to an inner surface of the shell 30 and comprises an inner surface 96 for facing the heel HL and the medial and lateral sides MS, LS of the user's foot 11 and the ankle A of the user in use. The inner liner 36 may be made of a soft material (e.g., a fabric made of NYLON® fibers or any other suitable fabric).

Figure 4:
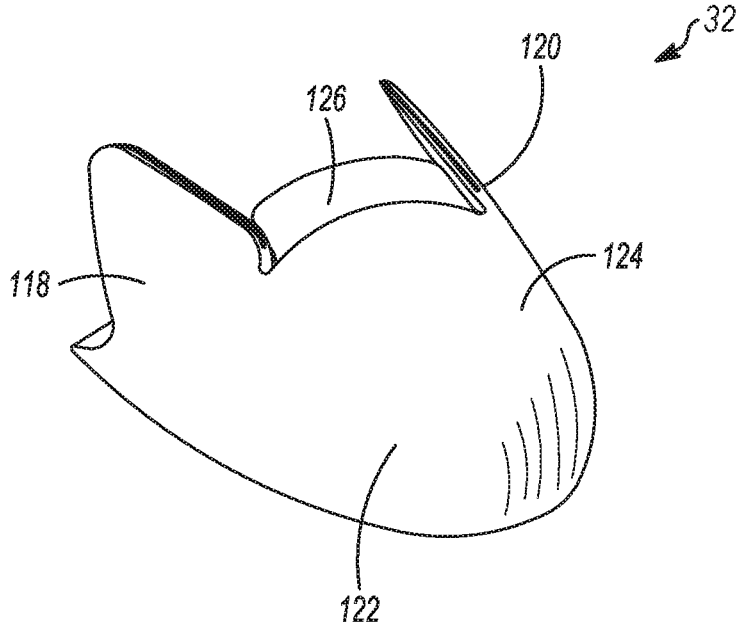
FIG. 4 is a front top perspective view of an embodiment of a toe cap of the skate.
Figure 5:
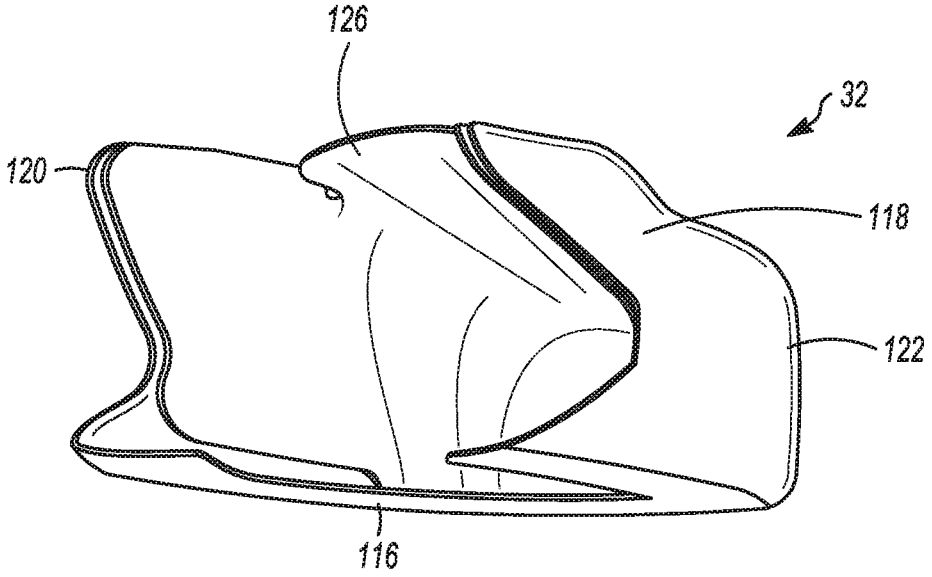
FIG. 5 is a rear bottom perspective view of the toe cap of FIG. 4.

The toe cap 32 of the skate boot 22 is configured to face and protect the toes T of the user's foot 11. In some examples, at least part (i.e., part or all) of the toe cap 32 may be formed integrally with the shell 30 and can thus be referred to as a toe portion of the shell 30. As shown in FIGS. 4 and 5, the toe cap 32 comprises a bottom portion 116 for at least partially covering a front portion of a lower surface 23 of the insole 40, a lateral side portion 118 for facing a small toe of the foot 11 of the user, a medial side portion 120 for facing a big toe of the foot 11 of the user, an end portion 122 between the lateral and medial side portions 118, 120, an upper portion 124 for facing a top of the toes T of the user's foot 11, and a top extension 126 for affixing the tongue 34 to the toe cap 32. The top extension 126 of the toe cap 32 may be affixed (e.g., glued and/or stitched) to a distal end portion of the tongue 34 in order to affix the tongue 34 to the toe cap 32.

The toe cap 32 may comprise any suitable material that imparts stiffness. For instance, in various embodiments, the toe cap 32 may comprise nylon, polycarbonate materials (e.g., Lexan®), polyurethane, thermoplastics, thermosetting resins, reinforced thermoplastics, reinforced thermosetting resins, polyethylene, polypropylene, high density polyethylene or any other suitable material. In some cases, the toe cap 32 may comprise composite material comprising thermoset material, thermoplastic material, carbon fibers and/or fiberglass fibers. For example, the composite material may be a fiber-matrix composite material that comprises a matrix in which fibers are embedded. The matrix may include any suitable polymeric resin, such as a thermosetting polymeric material (e.g., polyester, vinyl ester, vinyl ether, polyurethane, epoxy, cyanate ester, etc.), a thermoplastic polymeric material (e.g., polyethylene, polyurethane, polypropylene, acrylic resin, polyether ether ketone, polyethylene terephthalate, polyvinyl chloride, polymethyl methacrylate, polycarbonate, acrylonitrile butadiene styrene, nylon, polyimide, polysulfone, polyamide-imide, self-reinforcing polyphenylene, etc.), or a hybrid thermosetting-thermoplastic polymeric material. The fibers may be made of any suitable material such as carbon fibers, polymeric fibers such as aramid fibers, boron fibers, glass fibers, ceramic fibers, etc.

Figure 6:
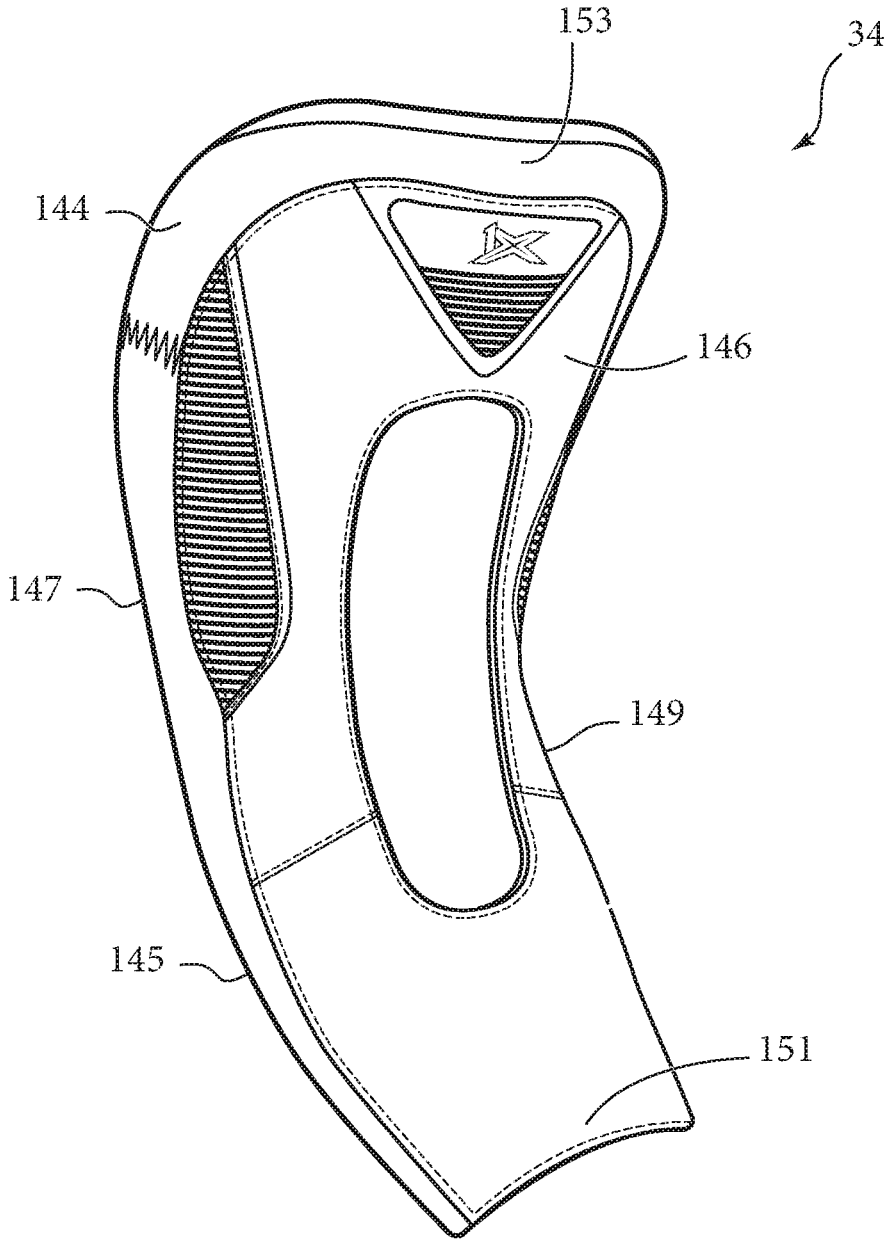
FIG. 6 is a front perspective view of an embodiment of a tongue of the skate.
Figure 7:
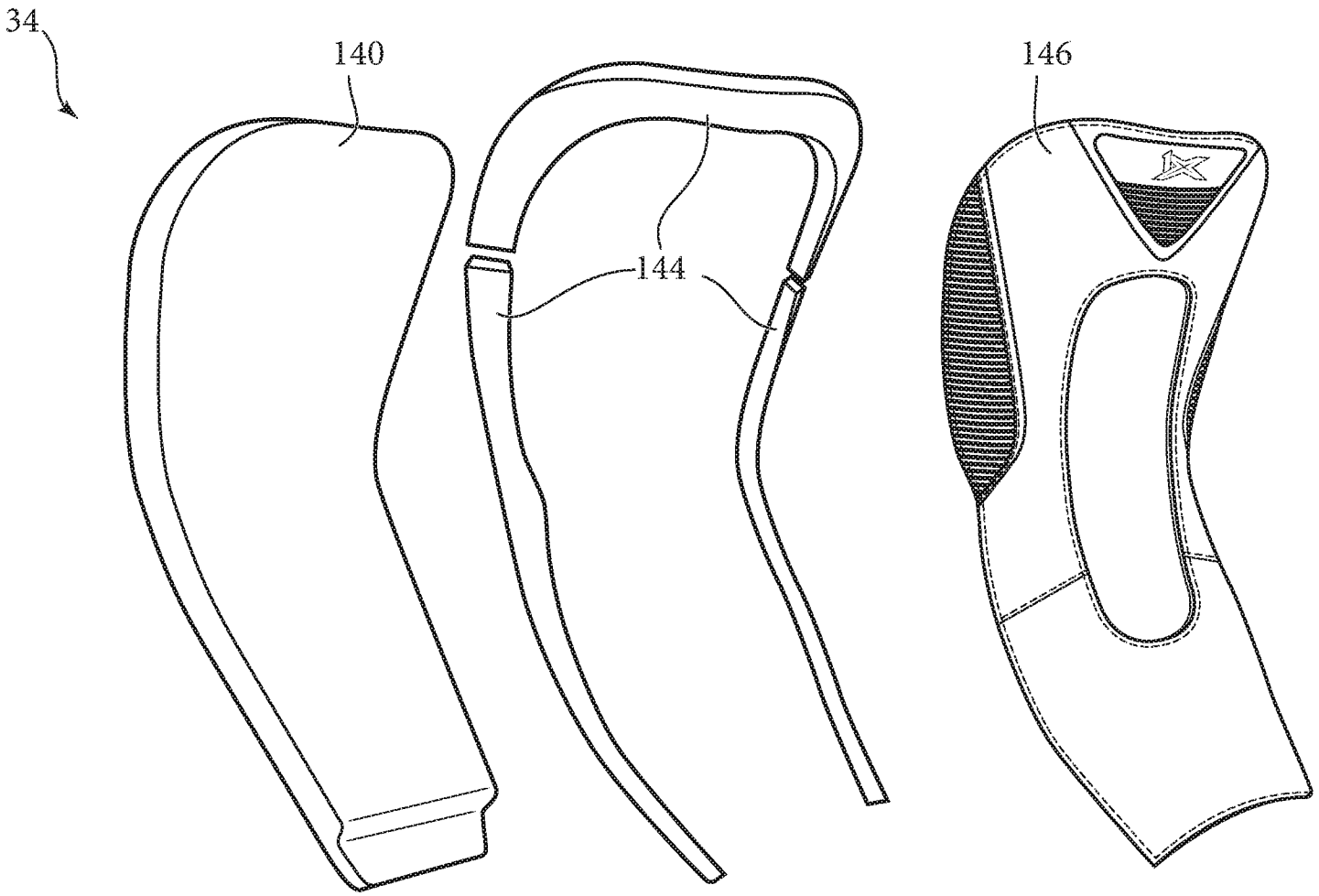
FIG. 7 is an exploded perspective view of the tongue of FIG. 6 including a core, a peripheral member and a cover member.

The tongue 34 extends upwardly and rearwardly from the toe cap 32 for overlapping the top surface TS of the user's foot 11. In this embodiment, as shown in FIGS. 6 and 7, the tongue 34 comprises a core 140 defining a section of the tongue 34 with increased rigidity, a padding member (not shown) for absorbing impacts to the tongue 34, a peripheral member 144 for at least partially defining a periphery 145 of the tongue 34, and a cover member 146 configured to at least partially define a front surface of the tongue 34. The tongue 34 defines a lateral portion 147 overlying a lateral portion of the user's foot 11 and a medial portion 149 overlying a medial portion of the user's foot 11. The tongue 34 also defines a distal end portion 151 for affixing to the toe cap 32 (e.g., via stitching) and a proximal end portion 153 that is nearest to the user's shin S.

The tendon guard 35 extends upwardly from the rear portion 84 of the ankle portion 64 of the shell 30 in order to protect the user's Achilles tendon AT. In some embodiments, at least part (i.e., part or all) of the tendon guard 35 may be integrally formed with the shell 30 of the skate boot 22. In other embodiments, the tendon guard 35 may be a separate component from the shell 30 such that the tendon guard 35 is fastened to the shell 30 via one or more mechanical fasteners (e.g., via stitching, stapling, a screw, etc.) or in any other suitable way.

The insole 40 comprises an upper surface 25 for facing the plantar surface PS of the user's foot 11 and a lower surface 23 on which the shell 30 may be affixed. In some embodiments, the insole 40 may be affixed to the shell 30 of the skate boot 22. For example, in some embodiments, the insole 40 may be joined mechanically to the shell 30 of the skate boot 22 by one or more mechanical fasteners (e.g., a clip, a rivet, or any suitable fastener). In other embodiments, the insole 40 may be adhesively bonded to the shell 30 of the skate boot 22 via an adhesive. In yet other embodiments, the lower surface 23 of the insole 40 may be overmolded to the shell 30 of the skate boot 22.

In this embodiment, the outsole 60 is to be disposed outside of the cavity 54 of the skate boot 22 between the sole portion 69 of the shell 30 of the skate boot 22 and the blade holder 24 of the skating device 28. The outsole comprises an upper surface 42 for facing the plantar surface S of the user's foot 11 and a lower surface 45 for facing the blade holder 24. The outsole 60 is mounted to the sole portion 69 of the shell 30 of the skate boot 22.

In this example of implementation, the sole region 20 of the skate boot 22 is configured to be fastened to the blade holder 24 by a plurality of fasteners 72 extending through the sole region 20, including the outsole 60.

In this embodiment, with additional reference to FIGS. 18 to 42, the sole region 20 of the skate boot 22, including the outsole 60, provides enhanced power transfer of the user (e.g., when pushing-off and skating straight) and agility of the user (e.g., when turning).

More particularly, in this embodiment, the outsole 60 comprises a plurality of zones 80, 82 that have different material properties and are positioned differently (i.e., elsewhere than one another) in a longitudinal direction of the outsole 60. In this example, the zone 80 is a stiff zone located in a front portion 88 of the outsole 60 and configured to be beneath the toes T and the ball B of the user's foot 11 for enhanced power transfer, whereas the zone 82 is a resilient zone located in a rear portion 98 of the outsole 60, more resilient materially than the stiff zone 80, and configured to be disposed beneath the heel H of the user's foot 11 for enhanced agility of the user. In that sense, the stiff zone 80 and the resilient zone 82 respectively implement a "power" zone and an "agility" zone.

Thus, in this embodiment, the power zone 80 of the outsole 60 is configured to facilitate the user skating straight, such as by facilitating push-off and power transfer by the user while skating straight, while the agility zone 82 of the outsole 60 is configured to facilitate turns by the user while skating.

In this example, the agility zone 82 of the outsole 60 is configured to resiliently deform for allowing the heel portion 62 of the upper 48 of the skate boot 22 to move relative to the blade holder 24 and the blade 26 while the user skates. In particular, in this example, the agility zone 82 of the outsole 60 is configured to resiliently deform for allowing the heel portion 62 of the upper 48 of the skate boot 22 to move laterally (i.e., in the lateral direction of the skate boot 22) relative to the blade holder 24 and the blade 26 while the user skates. Movement of the heel portion 62 of the upper 48 of the skate boot 22 relative to the blade holder 24 and the blade 26 may include at least one of: rotation of the heel portion 62 of the upper 48 of the skate boot 22 relative to the blade holder 24 about a longitudinal axis 16 of the skate boot 22; and translation of the heel portion 62 of the upper 48 of the skate boot 22 relative to the blade holder 24 in the lateral direction of the skate boot 22. In this case, the outsole 60 is also configured to prevent rotation of the heel portion 62 of the upper 48 of the skate 10 relative to the skating device 28 about a lateral axis 18 of the skate boot 22.

More particularly, in this embodiment, the outsole 60 comprises a plurality of materials $\mathbf{14}_1$-$\mathbf{14}_M$ that are different and positioned differently in the longitudinal direction of the outsole 60.

Figure 20:
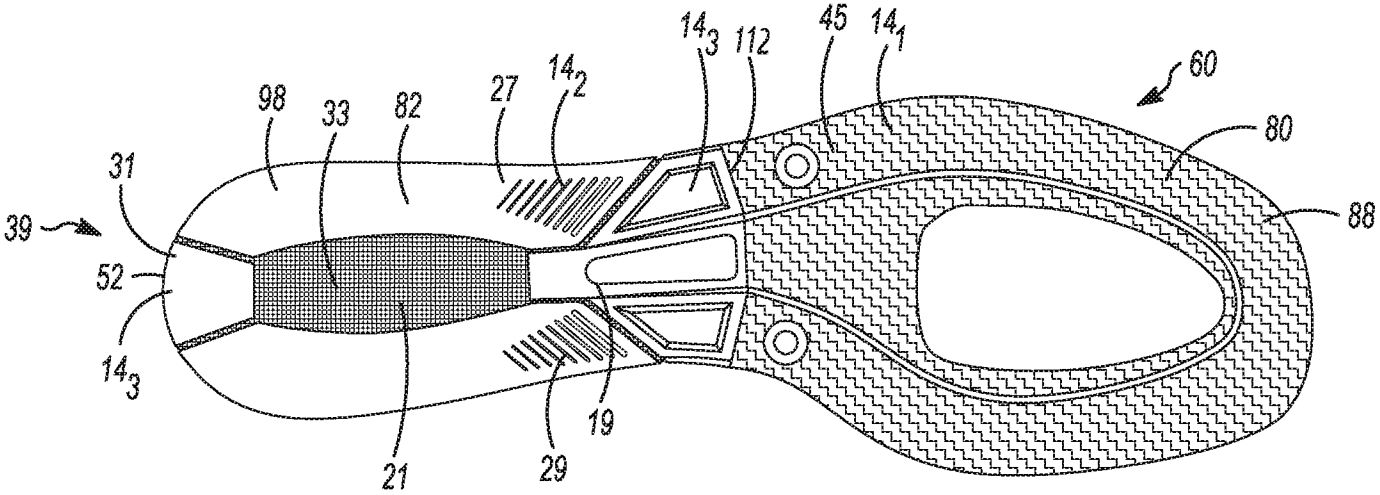
FIG. 20 is a bottom view of the outsole of the skate of FIGS. 18 and 19.
Figure 23:
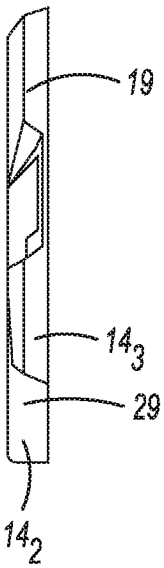
FIG. 23 is a front view of the rear portion of the outsole of FIG. 20.
Figure 21:
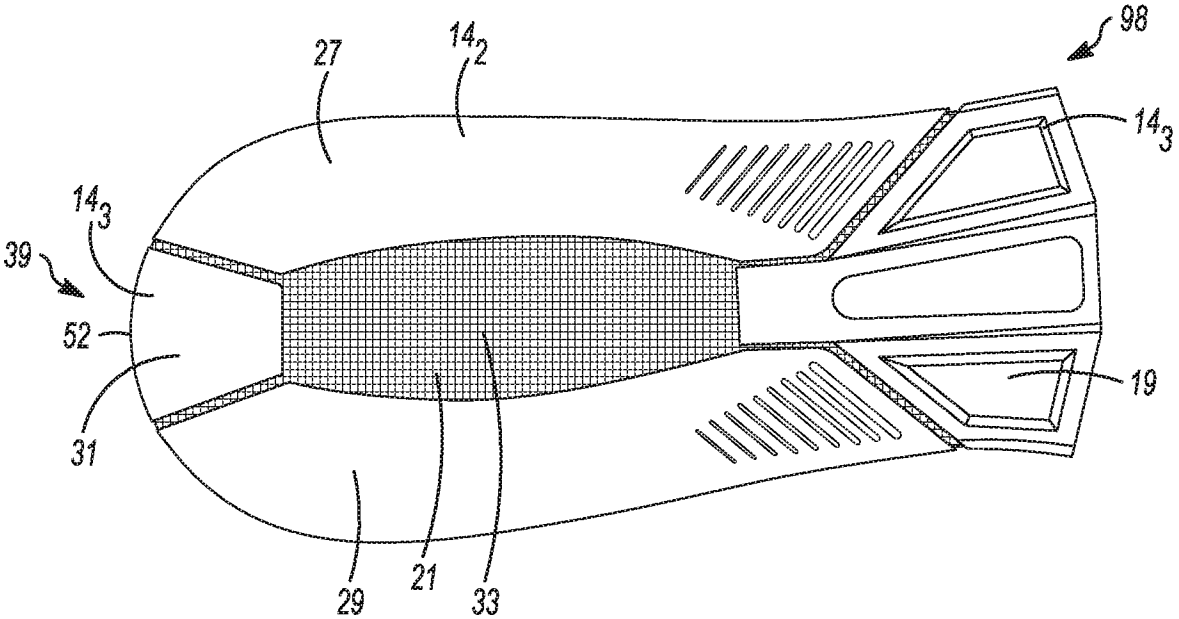
FIG. 21 is a bottom view of a rear portion of the outsole of FIG. 20.
Figure 22:
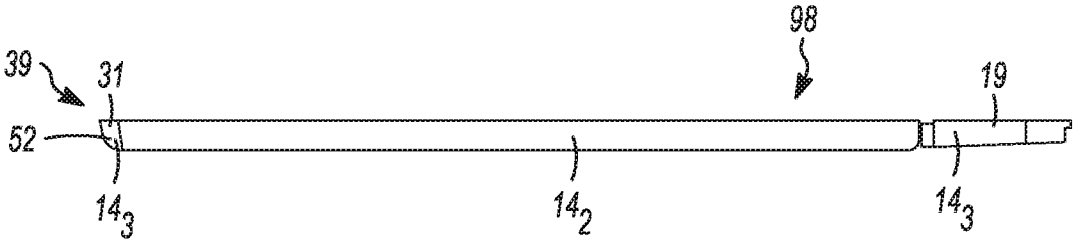
FIG. 22 is a side view of the rear portion of the outsole of FIG. 20.
Figure 24A:
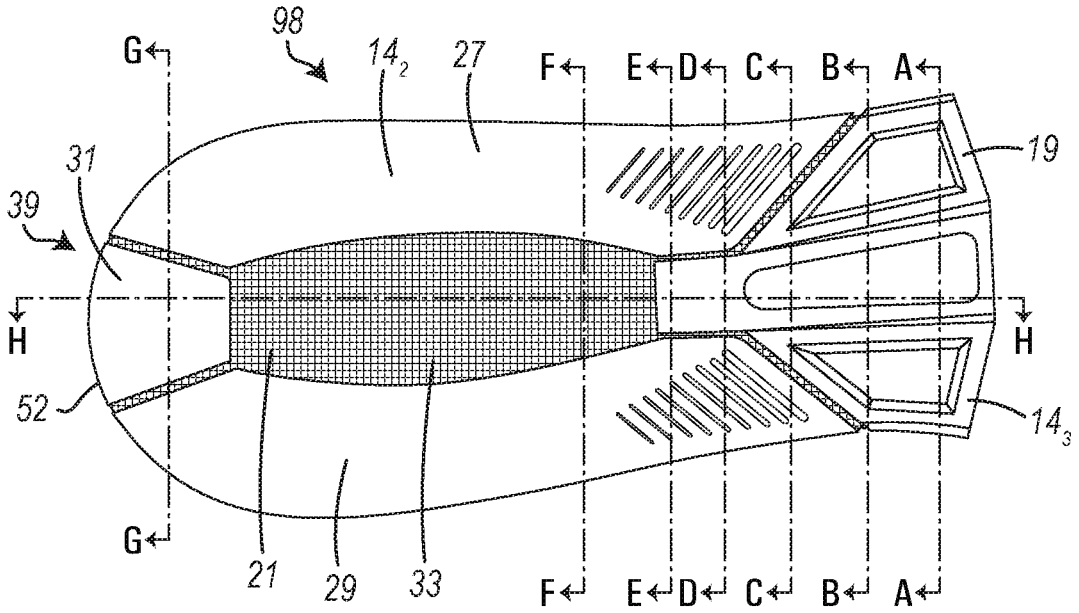
FIG. 24A is a bottom view of the rear portion of the outsole of FIG. 20 comprising section lines A to H.
Figure 24B:
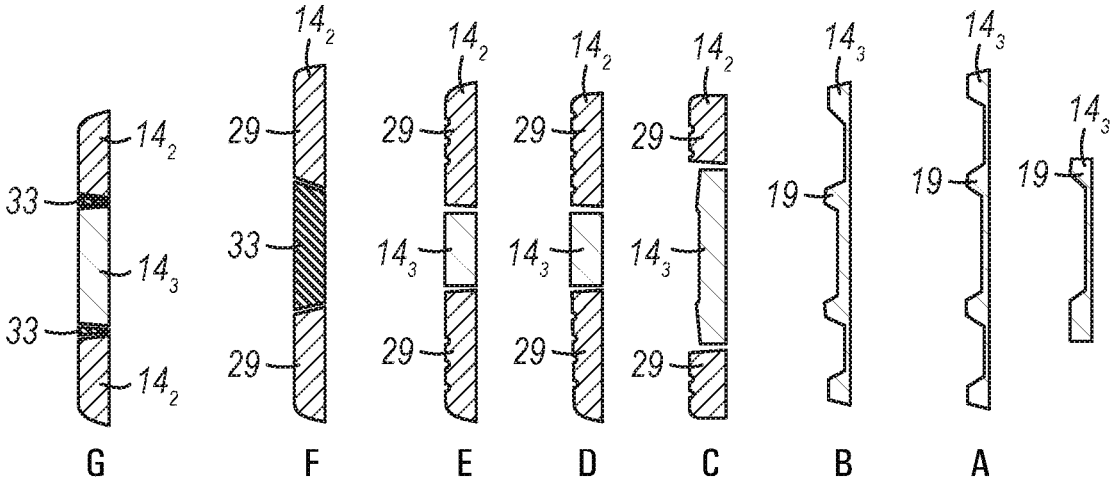
FIG. 24B shows cross-sectional views A to G taken along lines A to G of FIG. 24A.
Figure 24C:
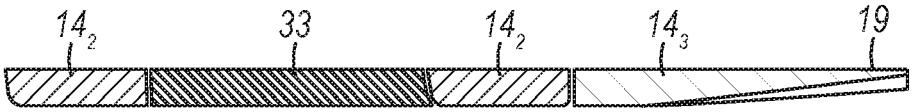
FIG. 24C is a cross-sectional view H taken along line H of FIG. 24C.
Figure 25:
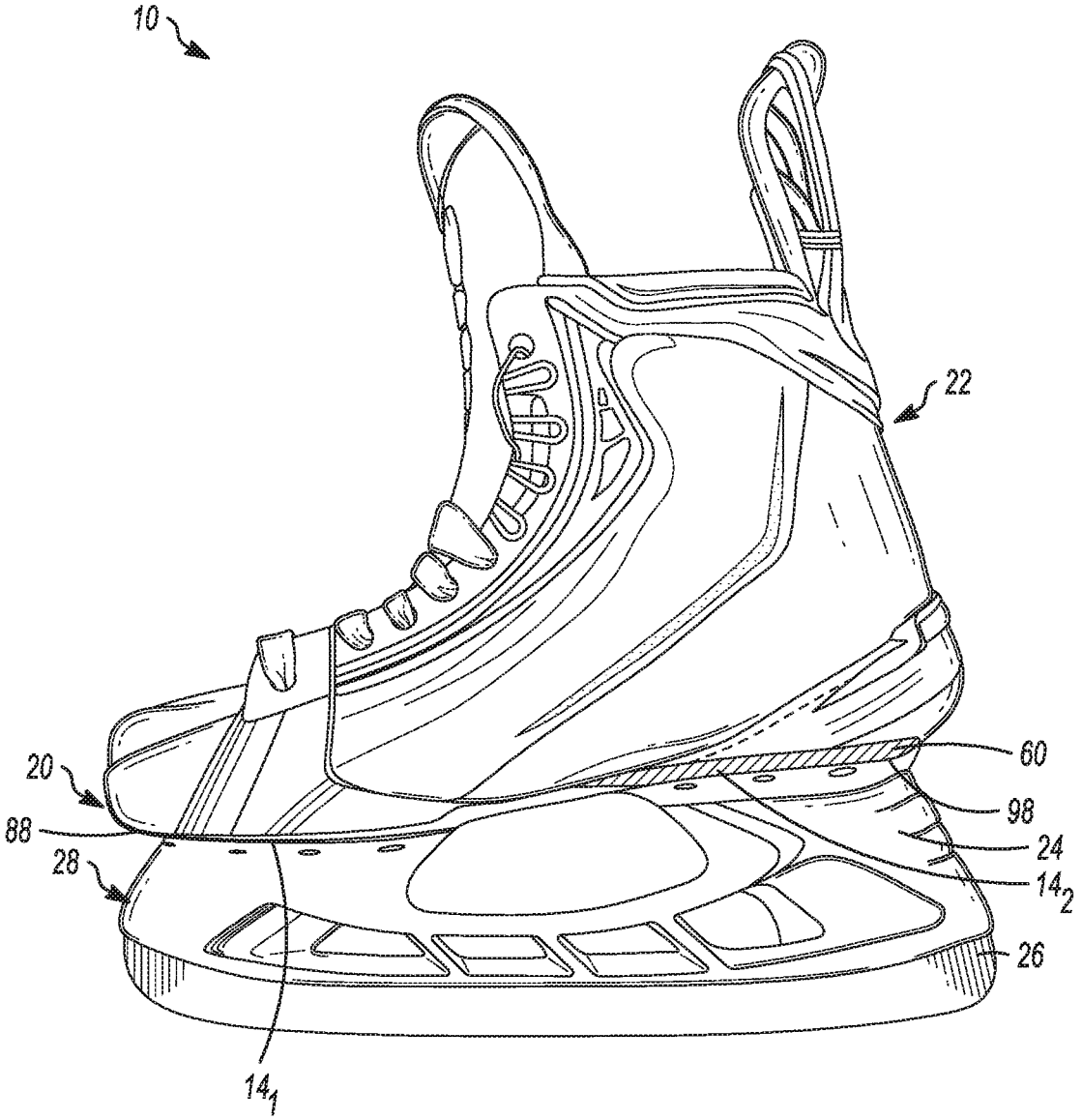
FIGS. 25 and 26 are side and rear views of the skate comprising another embodiment of the outsole.
Figure 26:
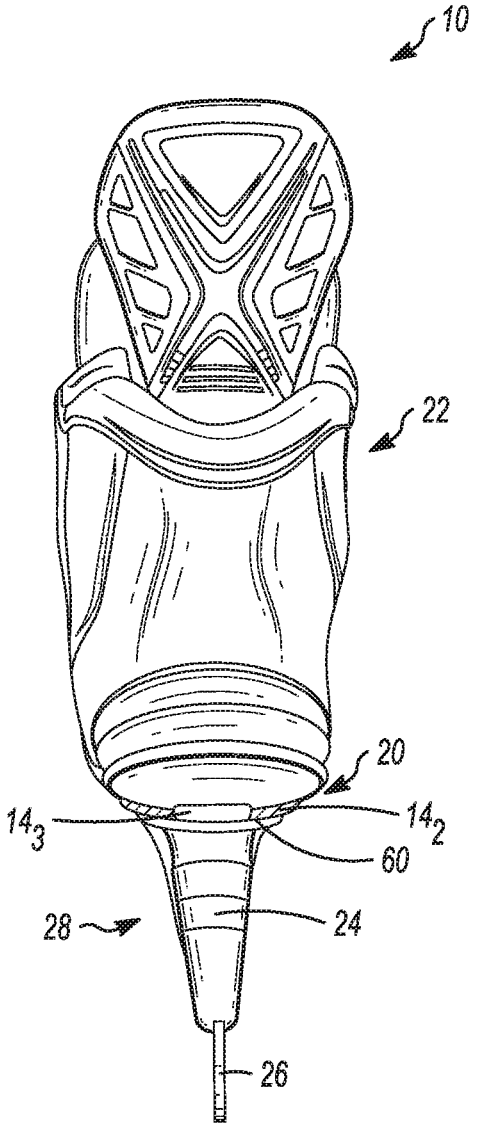
Figure 27:
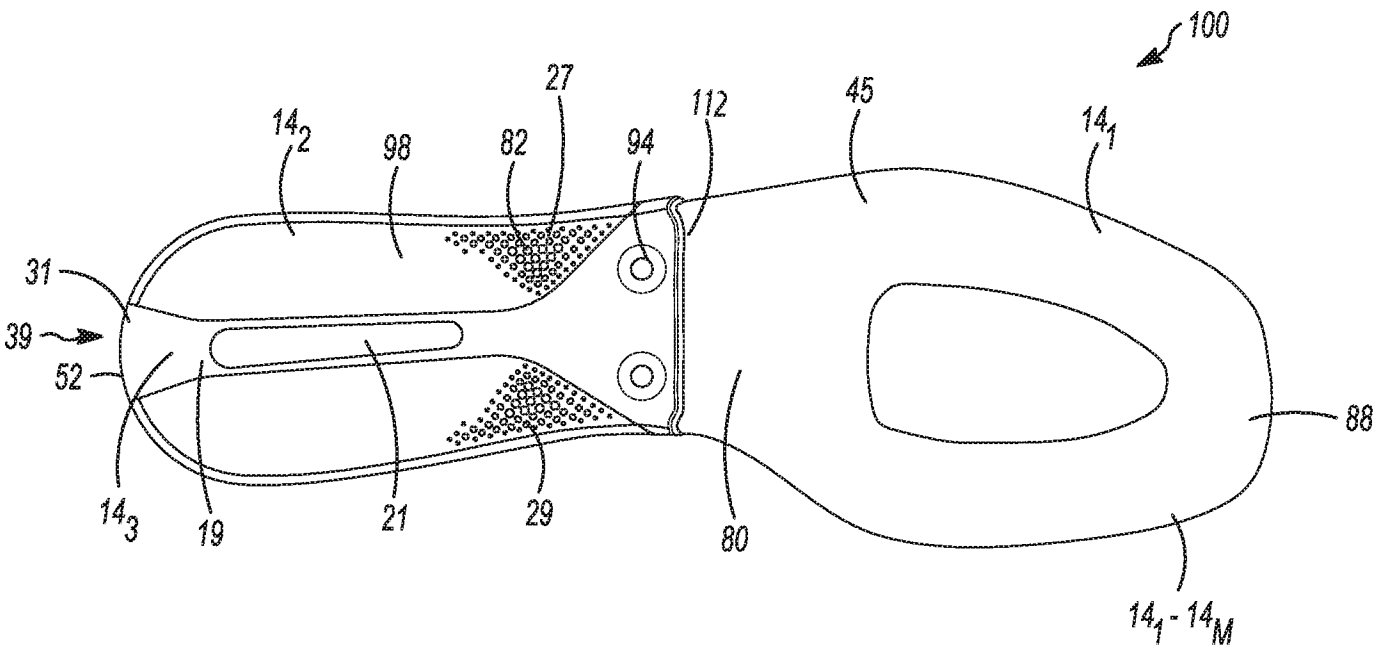
FIG. 27 is a bottom view of the outsole of FIGS. 25 and 26.
Figure 28:
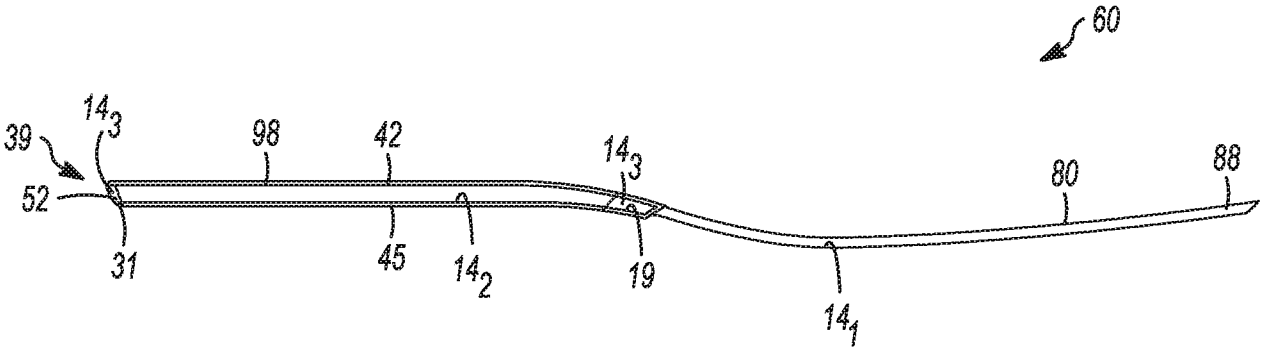
FIG. 28 is a side view of the outsole of FIG. 27.
Figure 29:
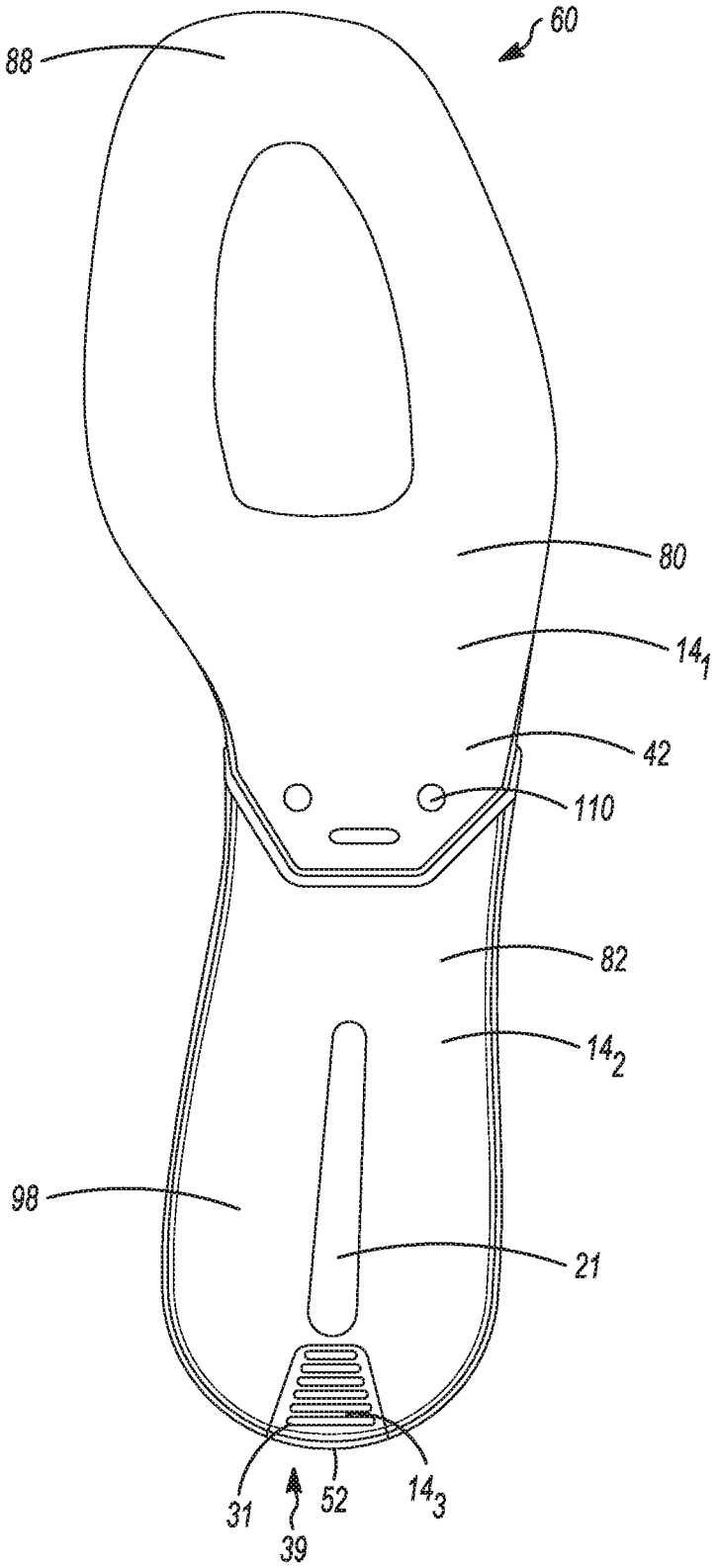
FIG. 29 is a top view of the outsole of FIG. 27.
Figure 30:
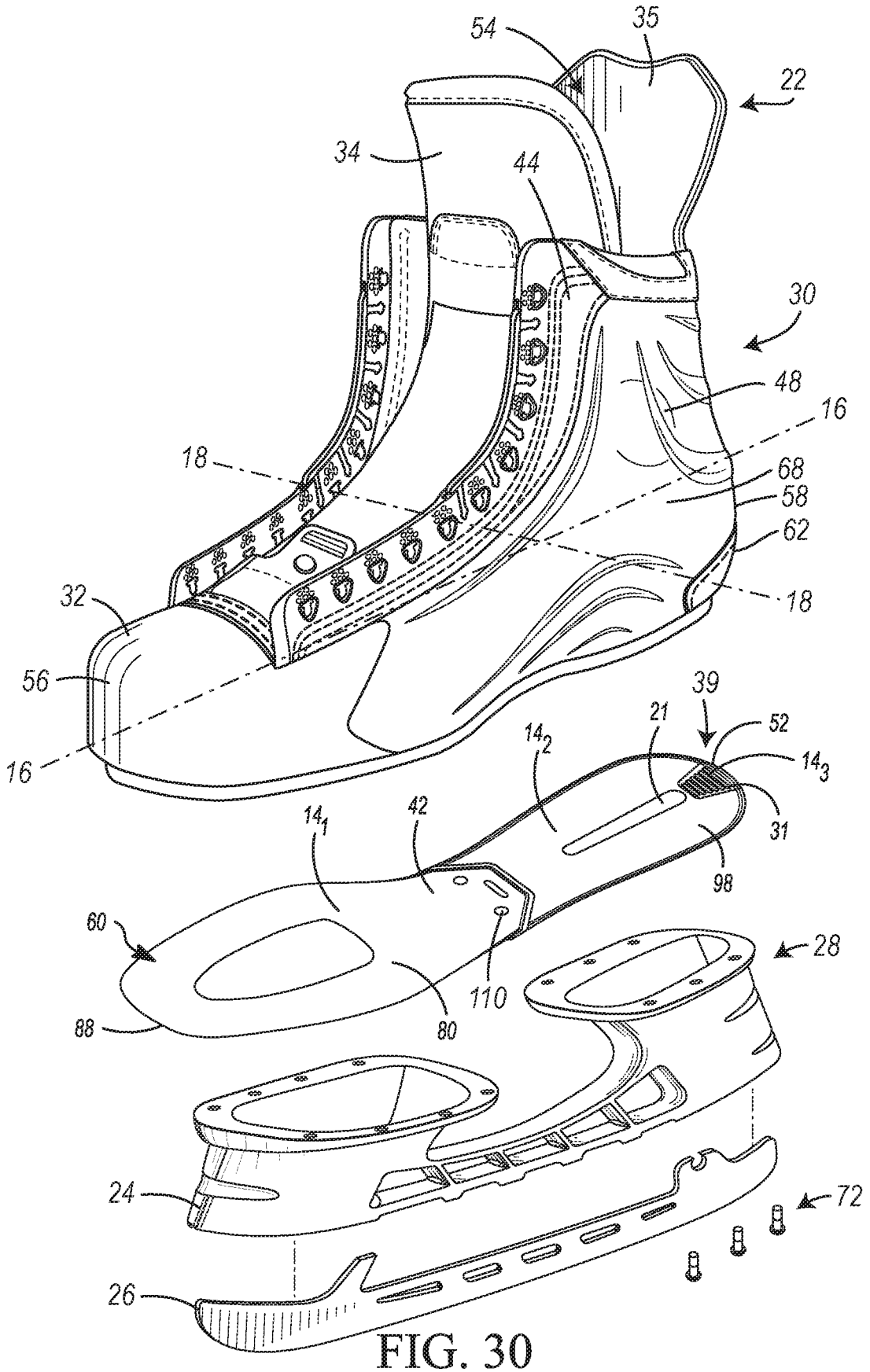
FIG. 30 is an exploded perspective view of the skate including the skate boot, the outsole of FIG. 27 and the skating device.
Figure 31:
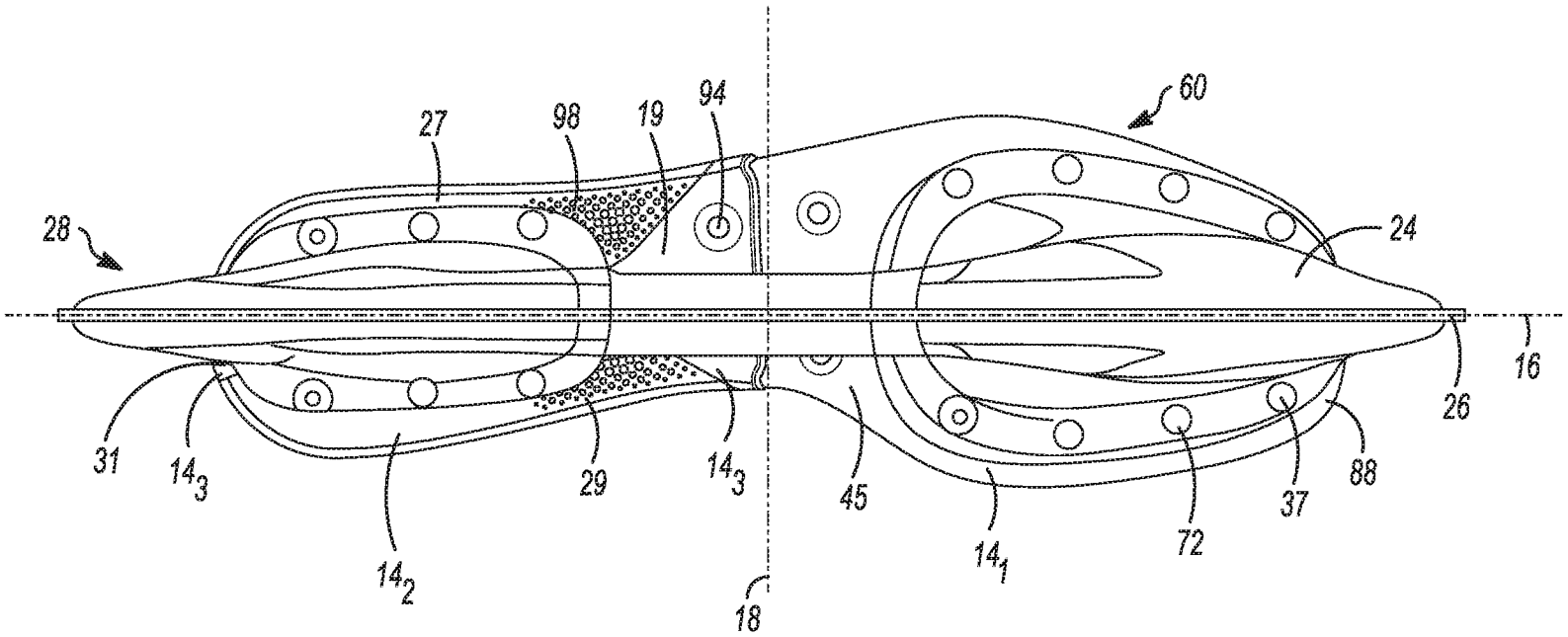
FIG. 31 is a bottom view of the skate.
Figure 32A:
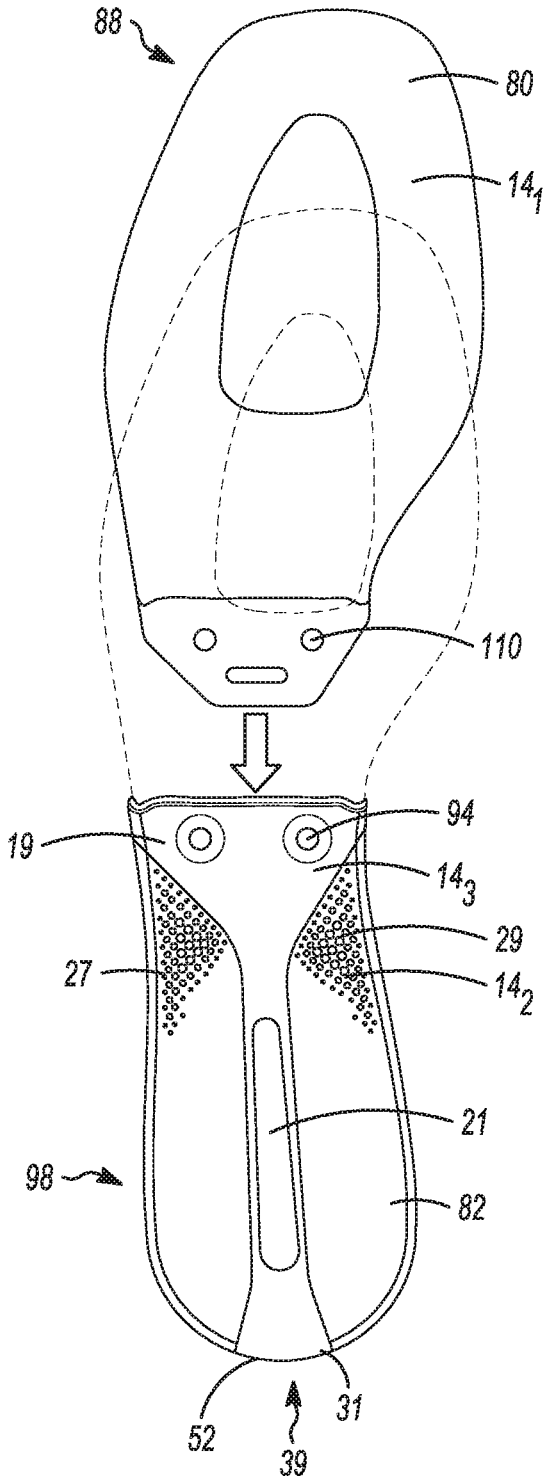
FIG. 32A is a bottom view of an assembly of a front portion of the outsole to the rear portion of the outsole.
Figure 32B:
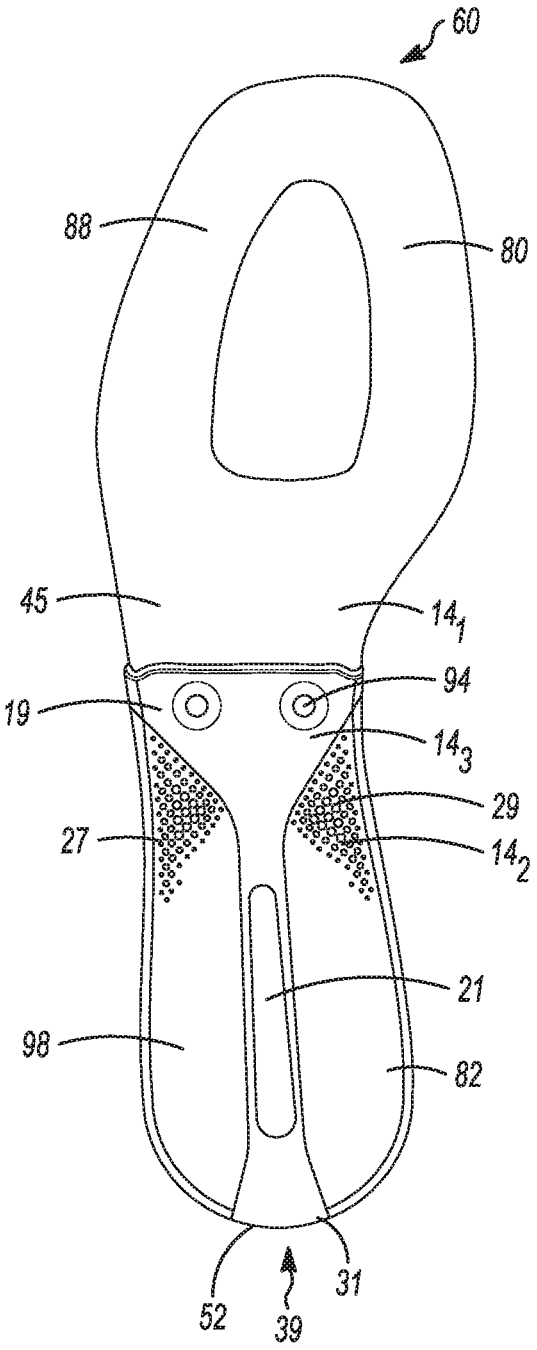
FIG. 32B is a bottom view of the assembled outsole of FIG. 32A.

As shown in FIG. 20, in this embodiment, the outsole 60 comprises a first material $\mathbf{14}_1$, which may be referred to as a "stiff" material, and a second material $\mathbf{14}_2$, which may be referred to as a "resilient" material.

The first material $\mathbf{14}_1$ of the outsole 60 is positioned in the front portion 88 of the outsole 60 and configured to be beneath the toes T and the ball B of the user's foot 11. Accordingly, the first material $\mathbf{14}_1$ is located in the power zone 80 of the outsole 60 and is configured to facilitate the user skating straight, such as by facilitating push-off and power transfer by the user while skating straight. In this embodiment, the first material $\mathbf{14}_1$ of the outsole 60 is configured to transfer more power to the skating device 28 while the user skates in a given direction than the second material $\mathbf{14}_2$ of the outsole 60.

The second material $\mathbf{14}_2$ of the outsole 60 is positioned in the rear portion 98 of the outsole 60 and is configured to be disposed beneath the heel HL of the user's foot 11. Accordingly, the second material $14_2$ is located in the agility zone 82 of the outsole 60 and is configured to facilitate turns by the user while skating.

In this embodiment, the rear portion 98 of the outsole 60 comprises a lateral part 27 and a medial part 29 which are spaced in a widthwise direction of the outsole 60 and include the second material $14_2$ of the outsole 60. In this example, the rear portion 98 of the outsole 60 comprises a gap 21 free of the second material $14_2$ of the outsole 60 between the lateral part 27 and the medial part 29 of the rear portion 98 of the outsole 60.

In this example, the second material $14_2$ is configured to resiliently deform (e.g., to resiliently compress) to facilitate turns by the user while skating.

More particularly, the second material $14_2$ of the outsole 60 is configured to resiliently deform for allowing movement of the heel portion 62 of the upper 48 of the skate boot 22 relative to the skating device 28 while the user skates. Thus, the second material $14_2$ allows the heel portion 62 of the upper 48 of the skate boot 22 to move relative to the skating device 28 while the user skates.

For example, the second material $14_2$ of the outsole 60 may be configured to resiliently deform to allow the heel portion 62 of the upper 48 of the skate boot 22 to move laterally relative to the skating device 28 while the user skates.

Thus, the second material $14_2$ may be configured to resiliently compress for allowing movement of the heel portion 62 of the upper 48 of the skate boot 22 relative to the skating device 28 while the user skates (e.g., for allowing the heel portion 62 of the upper 48 of the skate boot 22 to move, for example laterally, relative to the skating device 28 while the user skates).

The second material $14_2$ of the outsole 60 is more resilient than the first material $14_1$ of the outsole 60. Accordingly, a modulus of elasticity of the second material $14_2$ of the outsole 60 is lower than a modulus of elasticity of the first material $14_1$ of the outsole 60.

In this embodiment, a hardness of the second material $14_2$ of the outsole 60 is lower than a hardness of the first material $14_1$ of the outsole 60. For instance, in some embodiments, the second material $14_2$ may have a hardness ranging between Shore 34A and Shore 43A. Other values and ranges for the hardness of the second material $14_2$ are possible.

With further reference to FIGS. 18 to 23, 24A, 24B and 24C, the outsole 60 also comprises a third material $14_3$. Thus, in this example of implementation, the outsole 60 comprises at least three materials, $14_1$, $14_2$, $14_3$.

The third material $14_3$ of the outsole 60 is disposed between the first material $14_1$ and the second material $14_2$ of the outsole 60. The third material $14_3$ of the outsole 60 is more resilient than the first material $14_1$ and is less resilient than the second material $14_2$. Additionally, the third material $14_3$ is less stiff than the first material $14_1$ and stiffer than the second material $14_2$.

Also, in this example, the hardness of the third material $14_3$ of the outsole 60 is lower than the hardness first material $14_1$ of the outsole 60 and is higher than the hardness of the second material $14_2$ of the outsole 60. For instance, in some embodiments, the third material $14_3$ may have a hardness ranging between Shore 65A and Shore 70A. Other values and ranges for the hardness of the third material $14_3$ are possible.

In this embodiment, the rear portion 98 of the outsole 60 also comprises a frame 19 which includes the third material $14_3$ of the outsole 60. As shown in FIG. 20 for instance, the frame 19 is connected to the front portion 88 of the outsole 60 and tapers towards a rear end 39 of the outsole 60. In this example, the frame 19 supports the second material $14_2$ of the outsole 60 and interconnects the lateral part 27 and the medial part 29 of the outsole 60.

Also, in this example, the frame 19 comprises a rear end element 31 at a rear end part 52 of the outsole 60. The rear end element 31 also includes the third material $14_3$ of the outsole 60. As such, the third material $14_3$ of the outsole 60 is also disposed at the rear end part 52 of the outsole 60.

In this embodiment, as shown in FIGS. 20 to 23, 24A, 24B and 24C, the frame 19 may comprise a fabric 33. For example, the fabric 33 may be a woven fabric. In some embodiments, an intermediate element 114 made of the third material $14_3$ is disposed on the fabric 33 and spaced from the lateral part 27 and the medial part 29 of the rear portion 98 of the outsole 60.

In other embodiments, as shown in FIGS. 25 to 42, the frame 19 may be configured without a fabric.

The front portion 88 of the outsole 60 may be affixed to the rear portion 98 of the outsole 60 in any suitable fashion.

Figure 33A:
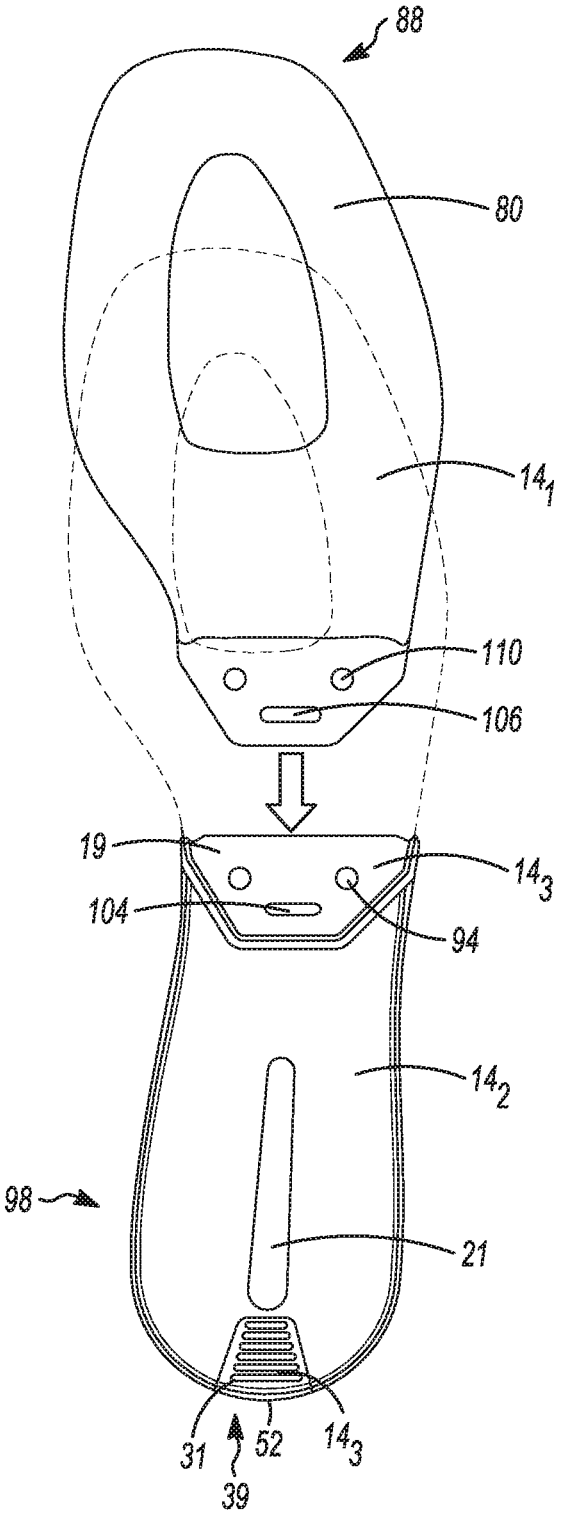
FIG. 33A is a top view of an assembly of the front portion of the outsole to the rear portion of the outsole.
Figure 33B:
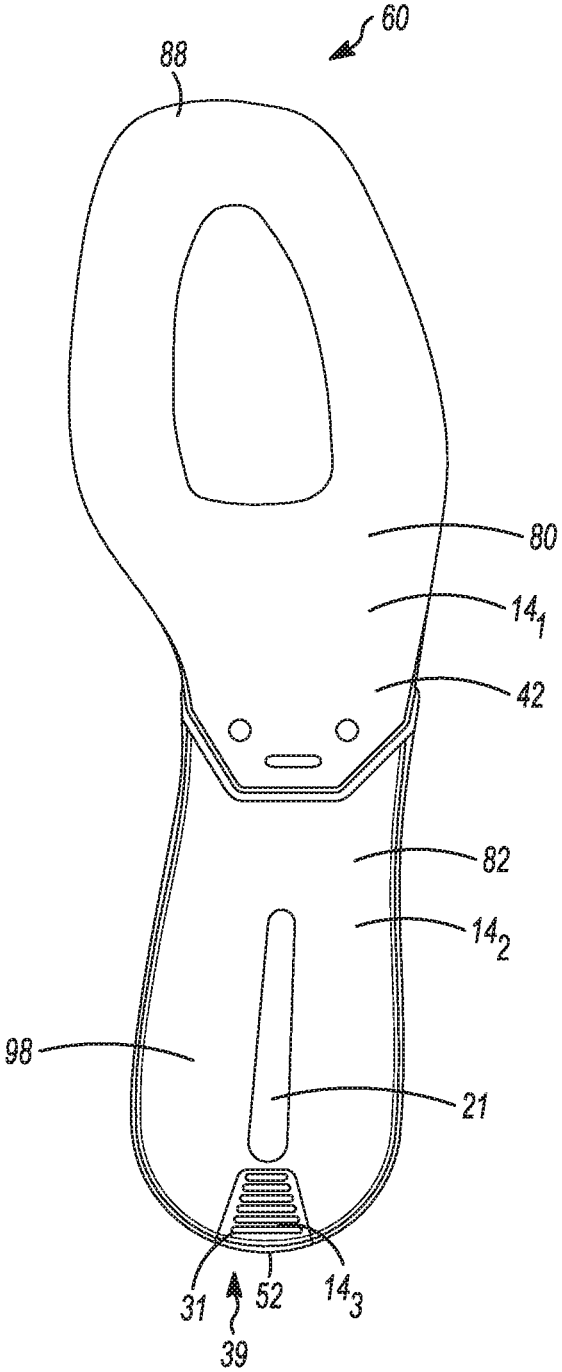
FIG. 33B is a top view of the assembled outsole of FIG. 33A.
Figure 36:
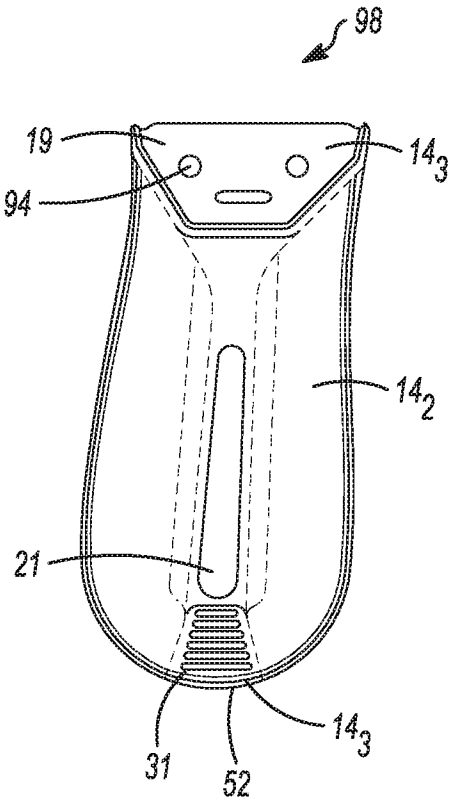
FIG. 36 is a top view of the rear portion of the outsole of FIG. 27 with a frame of the outsole being shown in dotted lines.
Figure 35:
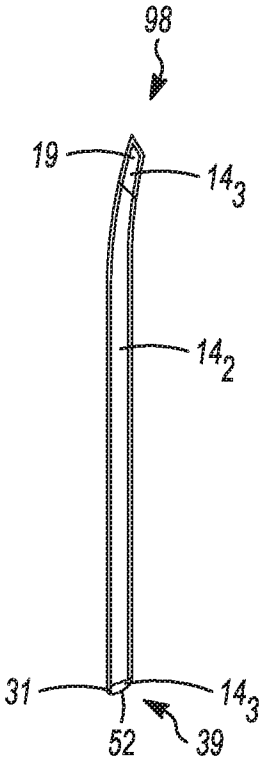
FIG. 35 is a side view of the rear portion of the outsole of FIG. 27.
Figure 34:
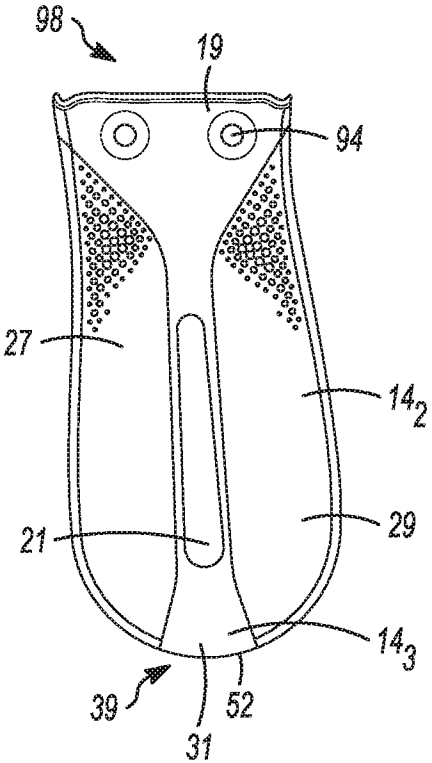
FIG. 34 is a bottom view of the rear portion of the outsole of FIG. 27.
Figure 38:
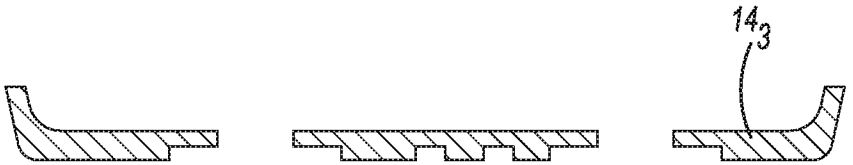
FIG. 38 is a cross-sectional view taken along lines A-A of FIG. 37.
Figure 39:
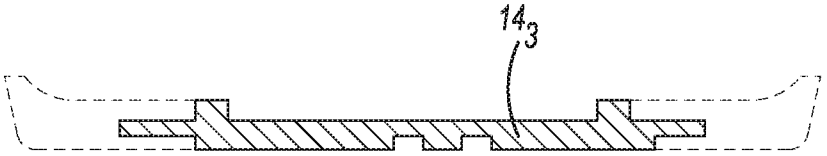
FIG. 39 is a cross-sectional view taken along lines B-B of FIG. 37.
Figure 40:
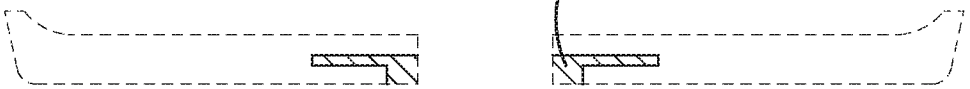
FIG. 40 is a cross-sectional view taken along lines C-C of FIG. 37.
Figure 37:
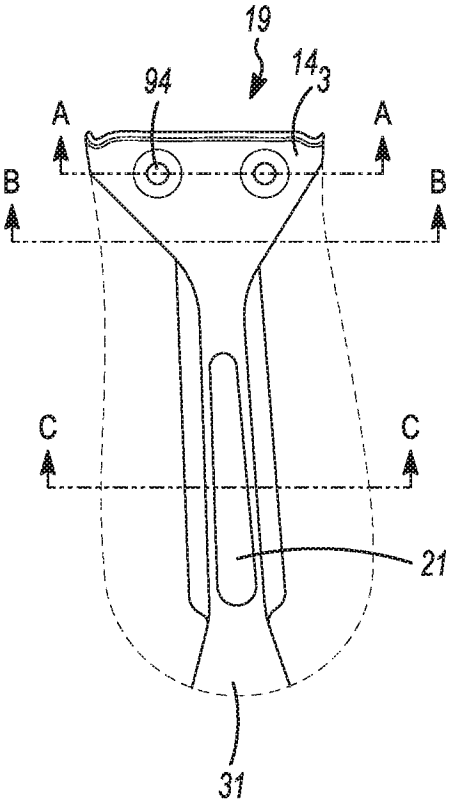
FIG. 37 is a bottom view of the frame of the outsole of FIG. 27 with medial and lateral parts of the rear portion of the outsole being shown in dashed lines and comprising section lines A to C.
Figure 42:
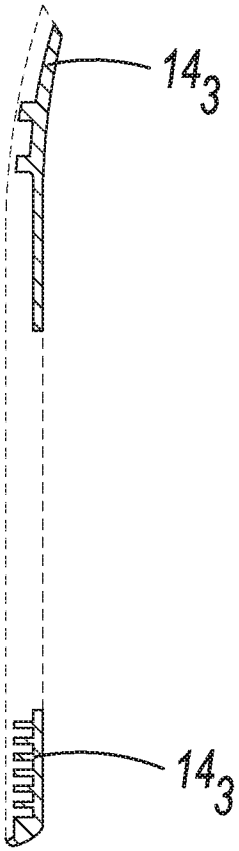
FIG. 42 is a cross-sectional view taken along lines D-D of FIG. 41.
Figure 41:
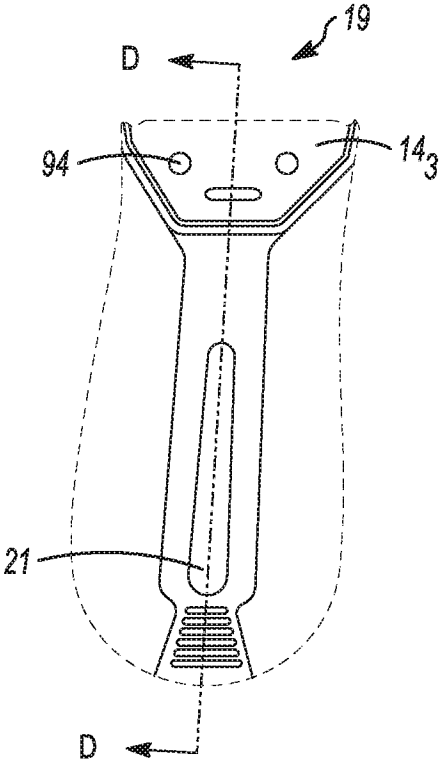
FIG. 41 is a top view of the frame of FIG. 37 with the medial and the lateral parts of the rear portion of the outsole being shown in dashed lines and comprising section line D.
Figure 43:
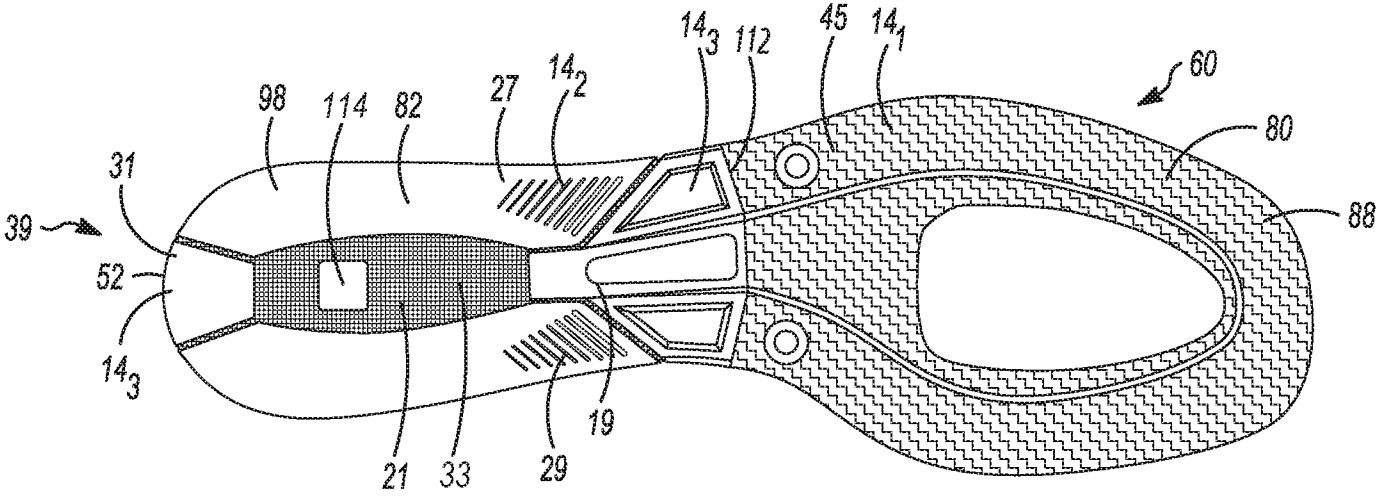
FIG. 43 is a variant of the outsole of FIG. 20.

In this embodiment, the front portion 88 of the outsole 60 is retained with the rear portion 98 of the outsole 60 via an adhesive 112. For additional fastening, the front portion 88 of the outsole 60 may also be retained with the rear portion 98 of the outsole 60 by the fasteners 72. In other embodiments, the front portion 88 if outsole 60 may be retained mechanically with the rear portion of the outsole 60 in a different fashion. Alternatively or additionally, the front portion 88 and the rear portion 98 of the outsole 60 may be mechanically interlocked via an interlocking portion 104 of one of the front portion 88 and the rear portion 98 of the outsole 60 that extends into an interlocking void 106 of the other one of the front portion 88 and the rear portion 98 of the outsole 60, as shown in FIG. 33A.

The outsole 60 may be configured to comprise a variety of suitable types of materials.

For instance, in some embodiments, the first material $14_1$ of the outsole 60 may be a composite material. More particularly, in some embodiments, the first material $14_1$ of the outsole 60 may be a fiber-reinforced polymeric material. For example, in some embodiments, the first material $14_1$ may include a fiber-reinforced plastic (FRP—a.k.a., fiber-reinforced polymer), comprising a polymeric matrix may include any suitable polymeric resin, such as a thermoplastic or thermosetting resin, like epoxy, polyethylene, polypropylene, acrylic, thermoplastic polyurethane (TPU), polyether ether ketone (PEEK) or other polyaryletherketone (PAEK), polyethylene terephthalate (PET), polyvinyl chloride (PVC), poly(methyl methacrylate) (PMMA), polycarbonate, acrylonitrile butadiene styrene (ABS), nylon, polyimide, polysulfone, polyamide-imide, self-reinforcing polyphenylene, polyester, vinyl ester, vinyl ether, polyurethane, cyanate ester, phenolic resin, etc., a hybrid thermosetting-thermoplastic resin, or any other suitable resin, and fibers such as carbon fibers, glass fibers, polymeric fibers such as aramid fibers (e.g., Kevlar fibers), boron fibers, silicon carbide fibers, metallic fibers, ceramic fibers, etc., which may be provided as layers of continuous fibers (e.g. pre-preg (i.e., pre-impregnated) layers of fibers held together by an amount of matrix).

In some embodiments, the second material $14_2$ of the outsole 60 may be a non-composite material. More particularly, in some embodiments, the second material $14_2$ of the outsole 60 may be a polymeric material without reinforcing fibers. For instance, in this example, the non-composite material $14_2$ may be an elastomeric material. For example, the elastomeric material $14_2$ may be polyurethane or silicone. In other embodiments, the non-composite material $14_2$ may comprise a high-density foam such as ethylene vinyl acetate (EVA) foam, molded high-density polyethylene (HDPE), irradiation cross-lined polyethylene (IXPE), expanded polypropylene (EPP) foam, expanded polyethylene (EPE) foam, vinyl nitrile (VN) foam, or any other suitable foam.

In some embodiments, the third material $14_3$ of the outsole 60 may comprise a polymeric material without reinforcing fibers. In other embodiments, the third material $14_3$ of the outsole 60 may comprise a non-elastomeric material.

The skating device 28 and the skate boot 22 may be affixed together in any suitable fashion.

As previously discussed, in this example of implementation, the sole region 20 of the skate boot 22 is configured to be fastened to the blade holder 24 by the fasteners 72 extending through the sole region 20, including the outsole 60. Thus, in this embodiment, the skate boot 22 is configured to be fastened to the skating device 28 by the fasteners 72 which extend through the outsole 60. The first material $14_1$ and the second material $14_2$ of the outsole 60 are each configured to receive respective ones of the fasteners 72. In other embodiments, the first material $14_1$, the second material $14_2$ and the third material $14_3$ of the outsole 60 are each configured to receive respective ones of the fasteners 72.

The first material $14_1$ and the second material $14_2$ of the outsole 60 may comprise recesses 94 and 110. The recesses 94, 110 may be configured to receive fasteners which may retain the front portion 88 of the outsole 60 and the rear portion 98 of the outsole. Additionally, the recesses 94, 110 may also be configured to provide ventilation to the outsole 60.

Any suitable fasteners may be used to fasten the skating device 28 and the skate boot 22. In this example, the fasteners 72 are rivets 37. Additionally, a length of the fasteners 72 may be selected such that the second material $14_2$ is not compressed due to the fastening of the skating device 28 and the skate boot 22 (i.e., by selecting fasteners 72 which are suitably long).

While in the embodiments discussed above, the outsole 60 comprises a plurality of materials $14_1$-$14_m$ that are different, in other embodiments, the outsole 60 may comprise a single material 15 configured such that the outsole 60 may provide enhanced power transfer of the user (e.g., when pushing-off and skating straight) and agility of the user (e.g., when turning).

In this embodiment, the outsole 60 comprises the stiff zone 80 and the resilient zone 82, each of the stiff zone 80 and the resilient zone 82 comprising the material 15. Thus, in this embodiment, the stiff zone 80 and the resilient zone 82, respectively implementing the "power" zone and the "agility" zone, comprise the same material 15 which may be shaped differently in each of the zones 80, 82.

Figure 49:
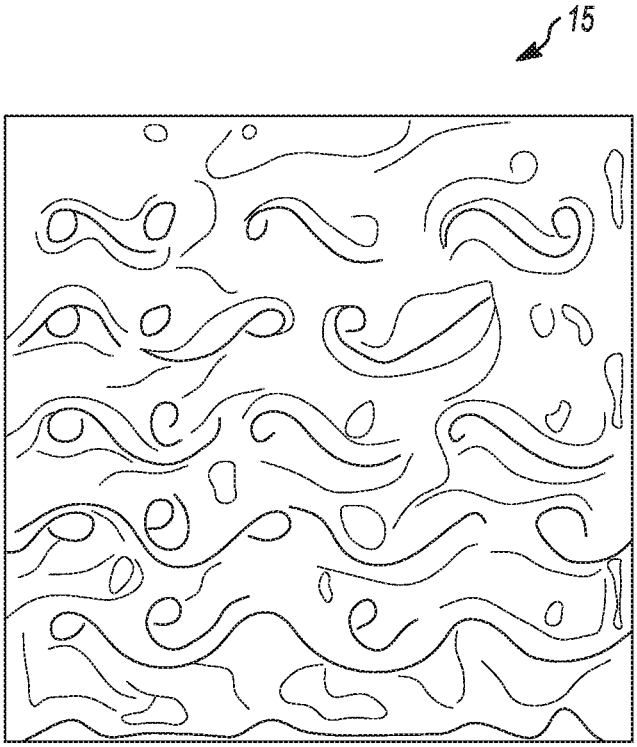
FIG. 49 is an example of a material comprising a structure that can resiliently deform.

In one example of implementation of this embodiment, the material 15 of the power zone 80 may be shaped so that the power zone 80 is stiff while the material 15 in the agility zone 82 of the outsole 60 may be shaped to resiliently deform. For example, the portion of the sole implementing the agility zone 82 may be created by additive manufacturing (e.g., 3D-printed) to create a structure which may resiliently deform, as shown in FIG. 49.

Figure 8:
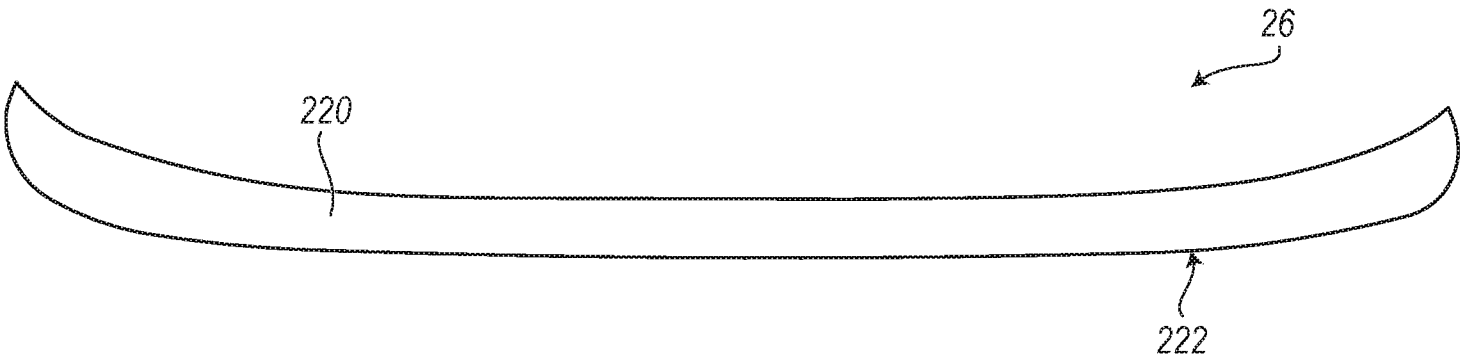
FIG. 8 is a side view of an embodiment of a skate blade of a skating device.

As shown in FIG. 8, the blade 26 comprises an ice-contacting material 220 including an ice-contacting surface 222 for sliding on the ice surface while the user skates. In this embodiment, the ice-contacting material 220 is a metallic material (e.g., stainless steel). The ice-contacting material 220 may be any other suitable material in other embodiments.

Figure 9:
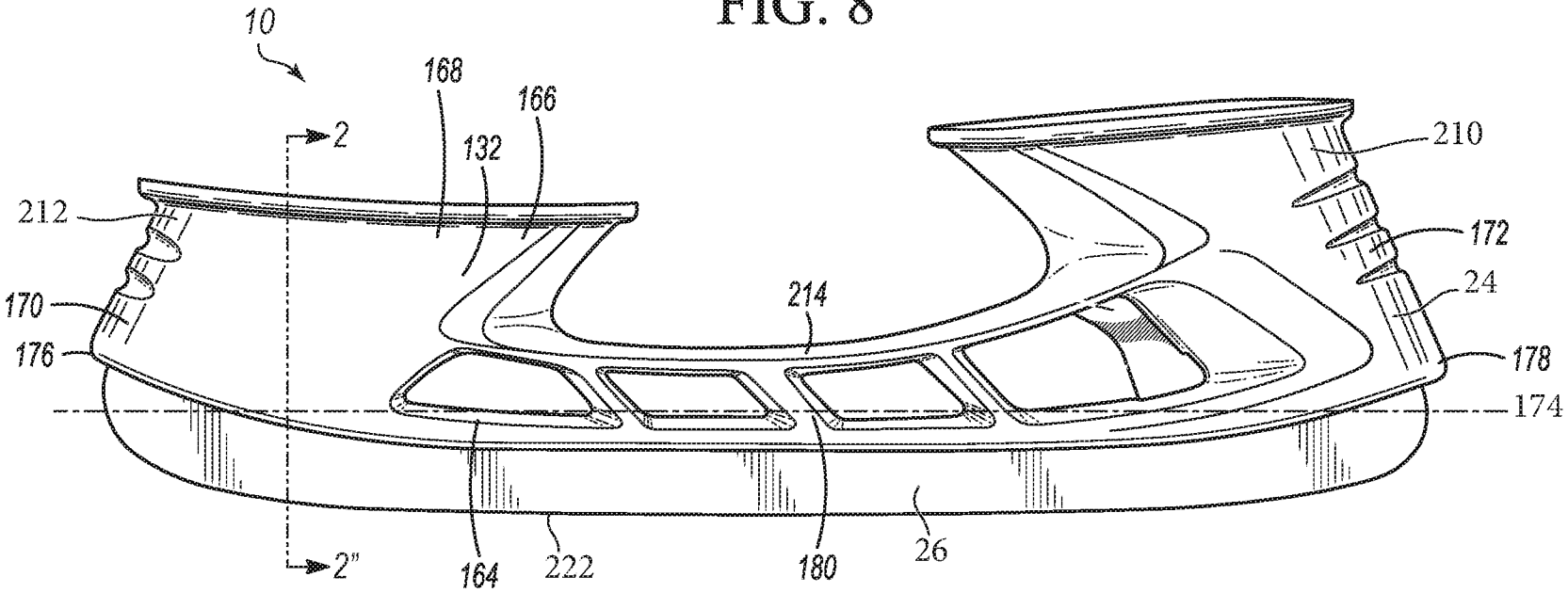
FIG. 9 is an embodiment of a blade holder of the skating device.
Figure 10:
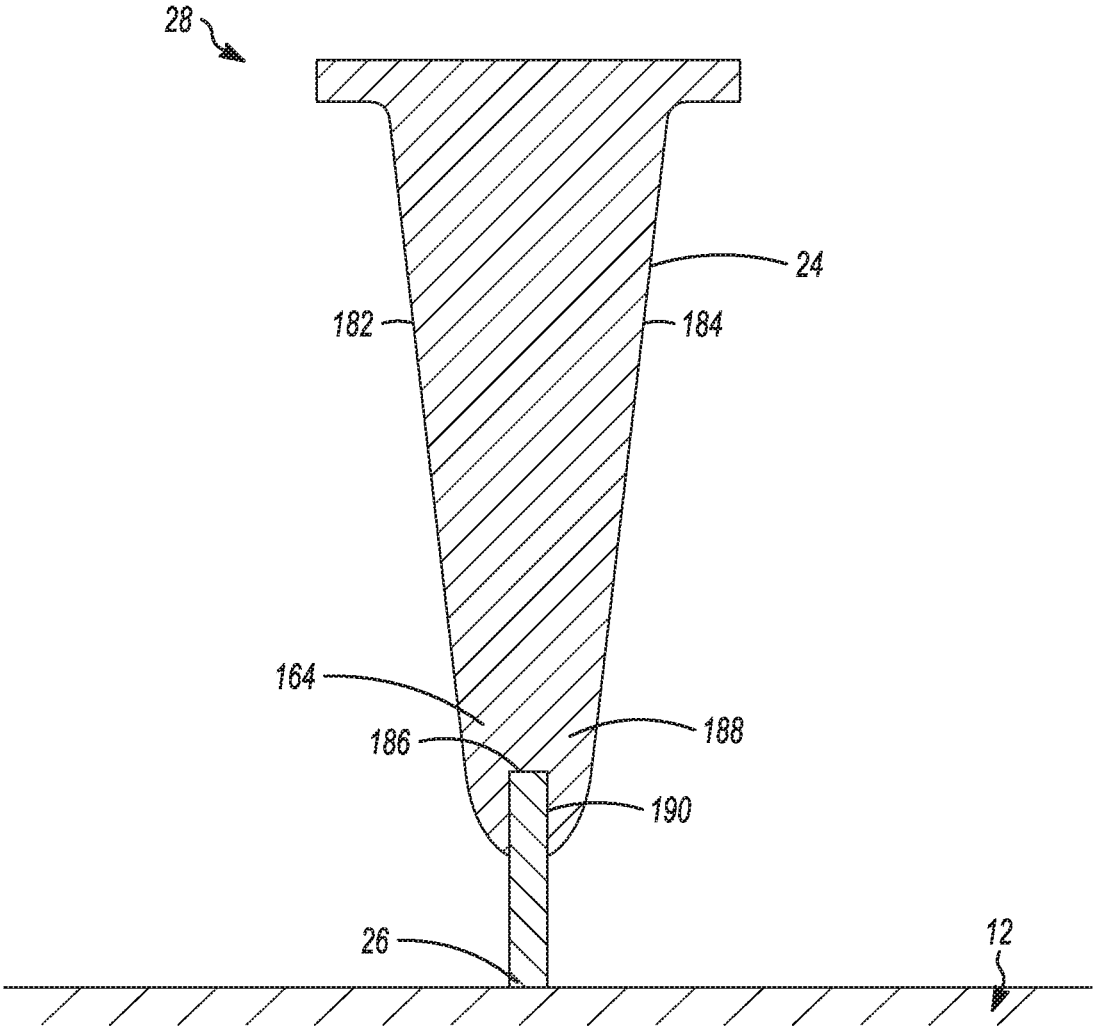
FIG. 10 is a cross-sectional view taken along lines 2-2" of FIG. 9.

As shown in FIG. 9, the blade holder 24 comprises a body 132 including a lower portion 162 comprising a blade-retaining base 164 that retains the blade 26 and an upper portion 166 comprising a support 168 that extends upwardly from the blade-retaining base 164 towards the skate boot 22 to interconnect the blade holder 24 and the skate boot 22. A front portion 170 of the blade holder 24 and a rear portion 172 of the blade holder 24 define a longitudinal axis 174 of the blade holder 24. The front portion 170 of the blade holder 24 includes a frontmost point 176 of the blade holder 24 and extends beneath and along the user's forefoot in use, while the rear portion 172 of the blade holder 24 includes a rearmost point 178 of the blade holder 24 and extends beneath and along the user's hindfoot in use. An intermediate portion 180 of the blade holder 24 is between the front and rear portions 170, 172 of the blade holder 24 and extends beneath and along the user's midfoot in use. The blade holder 24 comprises a medial side 182 and a lateral side 184 that are opposite one another.

The blade-retaining base 164 is elongated in the longitudinal direction of the blade holder 24 and is configured to retain the blade 26 such that the blade 26 extends along a bottom portion 186 of the blade-retaining base 164 to contact the ice surface 12. To that end, the blade-retaining base 164 comprises a blade-retention portion 188 to face and retain the blade 26. In this embodiment, the blade-retention portion 188 comprises a recess 190, which can be referred to as a "blade-receiving slot", extending from the front portion 170 to the rear portion 172 of the blade holder 24 in which an upper portion of the blade 26 is disposed. The blade-retaining base 164 may be configured in any other suitable way in other embodiments.

The support 168 is configured for supporting the skate boot 22 above the blade-retaining base 164 and transmit forces to and from the blade-retaining base 164 during skating. In this embodiment, the support 168 comprises a front pillar 210 and a rear pillar 212 which extend upwardly from the blade-retaining base 164 respectively towards a front sole part 83 and a rear sole part 87 of the skate boot 22. The front pillar 210, which can be referred to as a front "pedestal", extends towards the front portion 56 of the skate boot 22 and the rear pillar 212, which can be referred to as a rear "pedestal", extends towards the rear portion 58 of the skate boot 22. The blade-retaining base 164 extends from the front pillar 210 to the rear pillar 212. More particularly, in this embodiment, the blade-retaining base 164 comprises a bridge 214 interconnecting the front and rear pillars 210, 212.

The blade holder 24 may retain the blade 26 in any suitable way in various embodiments.

Figure 11:
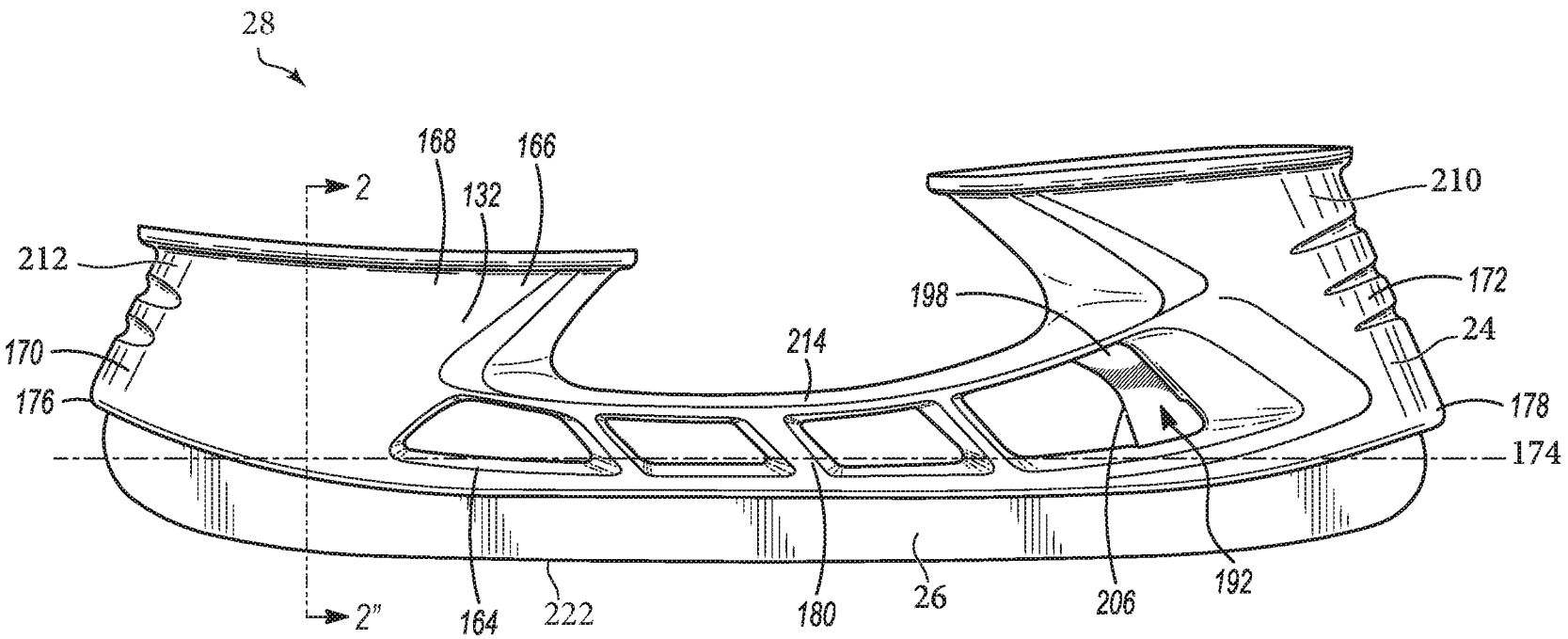
FIG. 11 is another embodiment of the blade holder.
Figure 12:
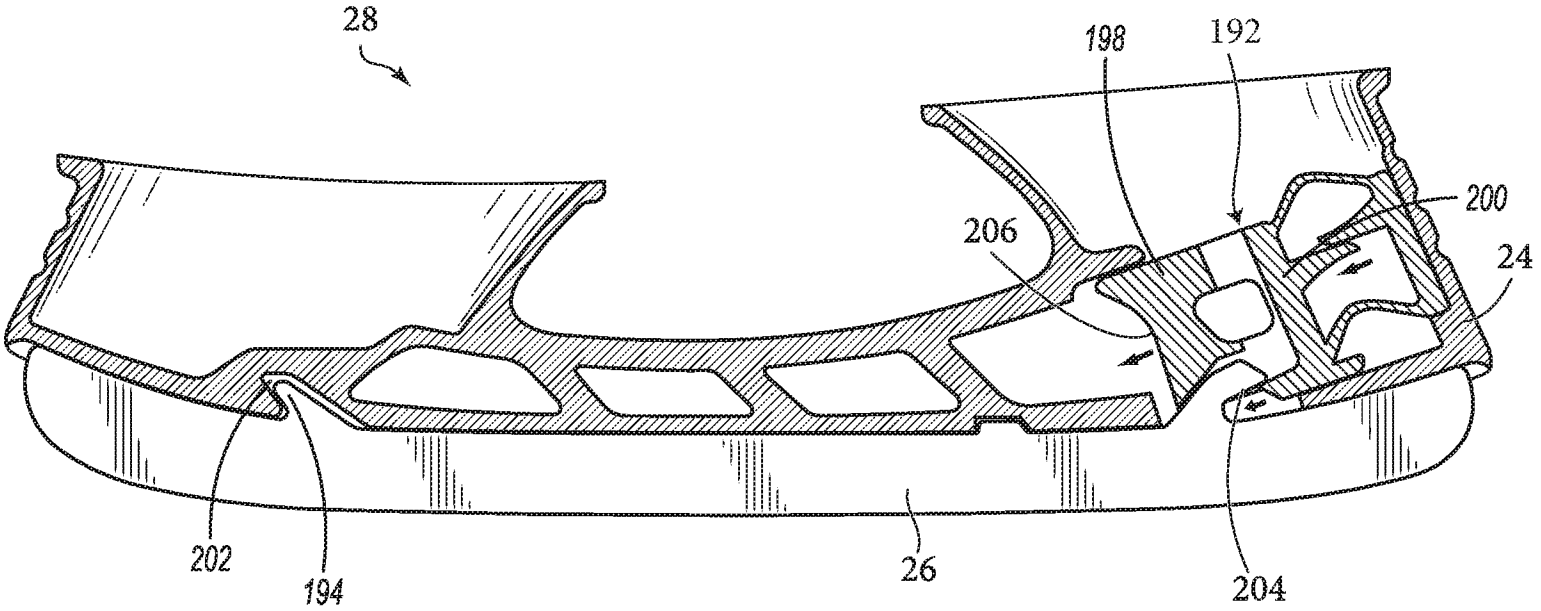
FIG. 12 is a cross-sectional view of the blade holder of FIG. 11.

For example, in some embodiments, as shown in FIGS. 11 and 12, the blade holder 24 comprises a blade-detachment mechanism 192 such that the blade 26 is selectively detachable and removable from, and attachable to, the blade holder 24 (e.g., when the blade 26 is worn out or otherwise needs to be replaced or removed from the blade holder 24).

More particularly, in this embodiment, the blade 26 includes a plurality of projections 194, 196. The blade-detachment mechanism 192 includes an actuator 198 and a biasing element 200 which biases the actuator 198 in a direction towards the front portion 170 of the blade holder 24. In this embodiment, the actuator 198 comprises a trigger. To attach the blade 26 to the blade holder 24, the front projection 194 is first positioned within a hollow space 202

(e.g., a recess or hole) of the blade holder 24. The rear projection 196 can then be pushed upwardly into a hollow space 204 (e.g., a recess or hole) of the blade holder 24, thereby causing the biasing element 200 to bend and the actuator 198 to move in a rearward direction. In this embodiment, the rear projection 196 will eventually reach a position which will allow the biasing element 200 to force the actuator 198 towards the front portion 170 of the blade holder 24, thereby locking the blade 26 in place. The blade 26 can then be removed by pushing against a finger-actuating surface 206 of the actuator 198 to release the rear projection 196 from the hollow space 204 of the blade holder 24. Thus, in this embodiment, the blade-detachment mechanism 192 is free of any threaded fastener (e.g., a screw or bolt) to be manipulated to detach and remove the blade 26 from the blade holder 24 or to attach the blade 26 to the blade holder 24.

Further information on examples of implementation of the blade-detachment mechanism 192 in some embodiments may be obtained from U.S. Pat. No. 8,454,030 hereby incorporated by reference herein. The blade-detachment mechanism 192 may be configured in any other suitable way in other embodiments.

Figure 13:
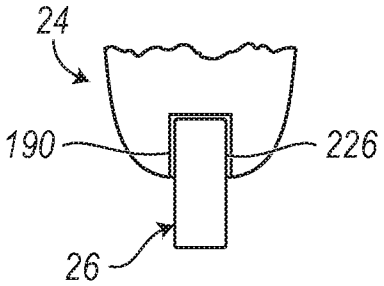
FIGS. 13 to 17 are different examples of embodiments in which the blade is affixed to the blade holder of the skating device of the skate.
Figure 14:
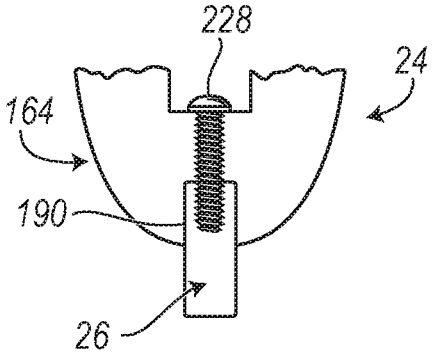
Figure 15:
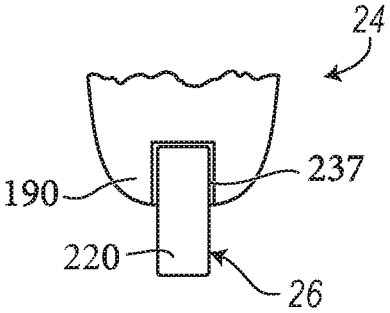
Figure 16:
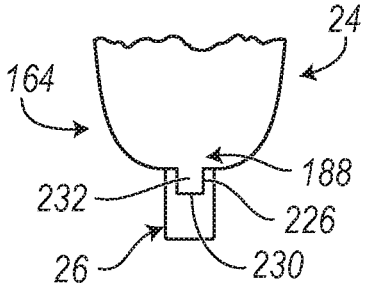

In some embodiments, the blade holder 24 may retain the blade 26 using an adhesive 226 and/or one or more fasteners 228. For instance, in some embodiments, as shown in FIG. 13, the recess 190 of the blade holder 24 may receive the upper portion of the blade 26 that is retained by the adhesive 226. The adhesive 226 may be an epoxy-based adhesive, a polyurethane-based adhesive, or any suitable adhesive. In some embodiments, instead of or in addition to using an adhesive, as shown in FIG. 14, the recess 190 of the blade holder 24 may receive the upper part of the blade 26 that is retained by the one or more fasteners 228. Each fastener 228 may be a rivet, a screw, a bolt, or any other suitable mechanical fastener. In some embodiment, the blade holder 24 may retain the blade 26 via a press fit. For example, as shown in FIG. 15, the recess 190 of the blade holder 24 may be configured (e.g., sized) such as to enter into a press fit with the blade 26. More particularly, in this example of implementation, the blade 26 comprises an elastomeric coating 237 including an elastomeric material (e.g., polyurethane, rubber, or any other suitable elastomeric material) that forms at least part of an outer surface of the blade 26. The elastomeric coating 237 has a greater friction coefficient than the ice-contacting material 220 of the blade 26 when interacting with the blade holder 24 such as to improve retention of the blade 26 by the blade holder 24 in a press fit. Alternatively or additionally, in some embodiments, as shown in FIG. 16, a blade-retention portion 188 of the blade holder 24 may extend into a recess 230 of the upper part of the blade 26 to retain the blade 26 using the adhesive 226 and/or the one or more fasteners 228. For instance, in some cases, the blade-retention portion 188 of the blade holder 24 may comprise a projection 232 extending into the recess 230 of the blade 26.

Figure 17:
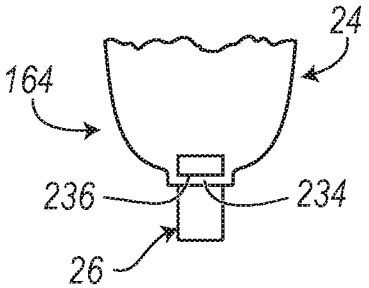
Figure 18:
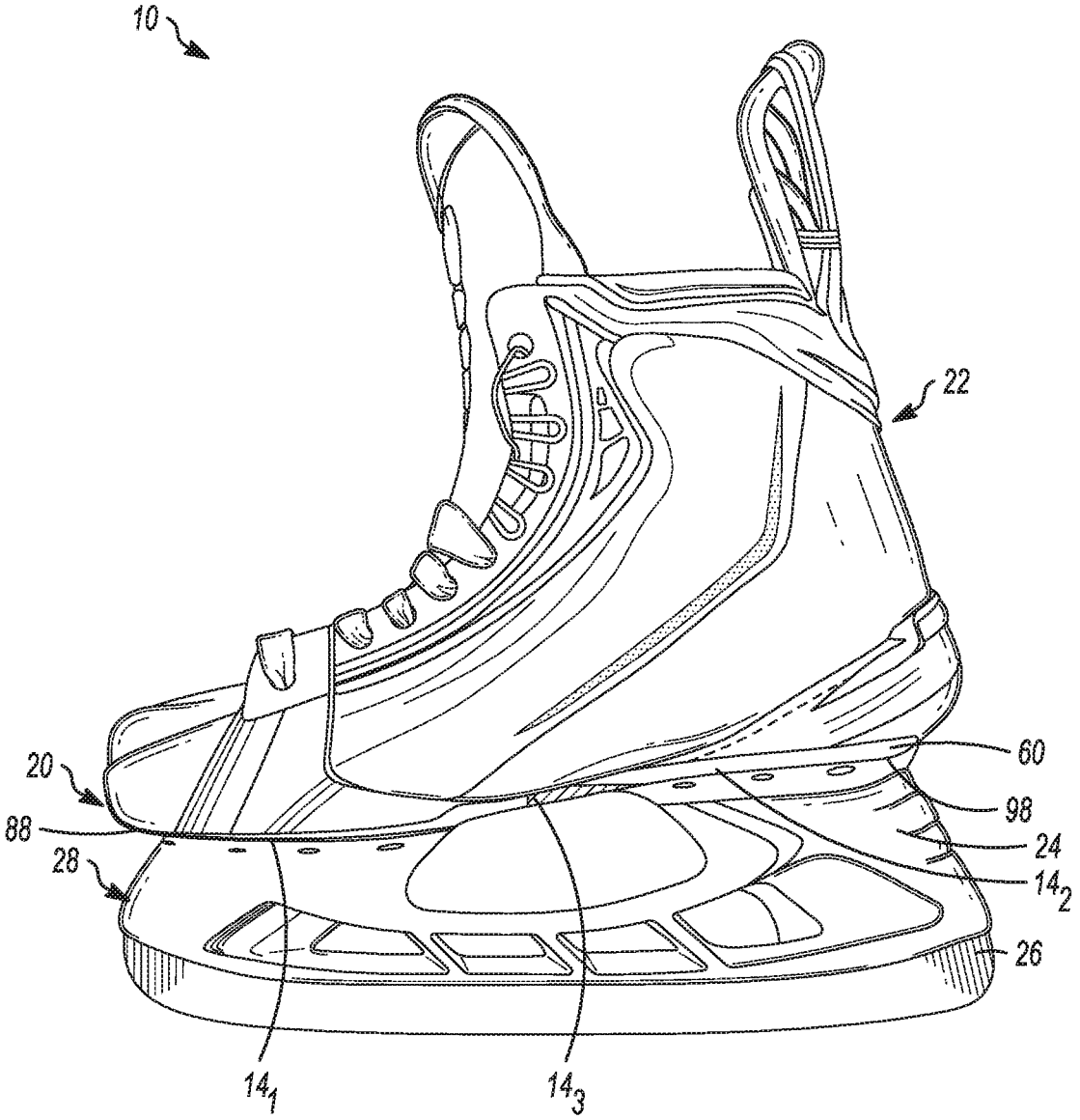
FIGS. 18 and 19 are side and rear views of the skate comprising an embodiment of an outsole disposed between the skate boot and the skating device and comprising a plurality of materials.
Figure 19:
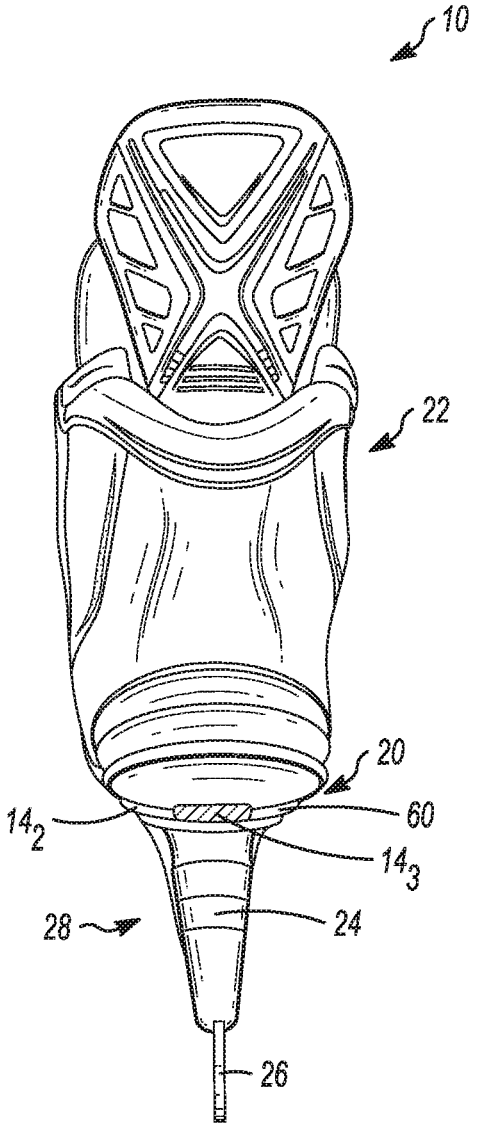

In some embodiments, the blade 26 may be permanently affixed to the blade holder 24 (i.e., not intended to be detached and removed from the blade holder 24). For example, as shown in FIG. 17, the blade 26 and the blade-retaining base 164 of the blade holder 24 may be mechanically interlocked via an interlocking portion 234 of one of the blade-retaining base 164 and the blade 26 that extends into an interlocking void 236 of the other one of the blade-retaining base 164 and the blade 26. For instance, in some cases, the blade 26 can be positioned in a mold used for molding the blade holder 24 such that, during molding, the interlocking portion 234 of the blade-retaining base 164 flows into the interlocking void 236 of the blade 26 (i.e., the blade holder 24 is overmolded onto the blade 26).

Figure 46:
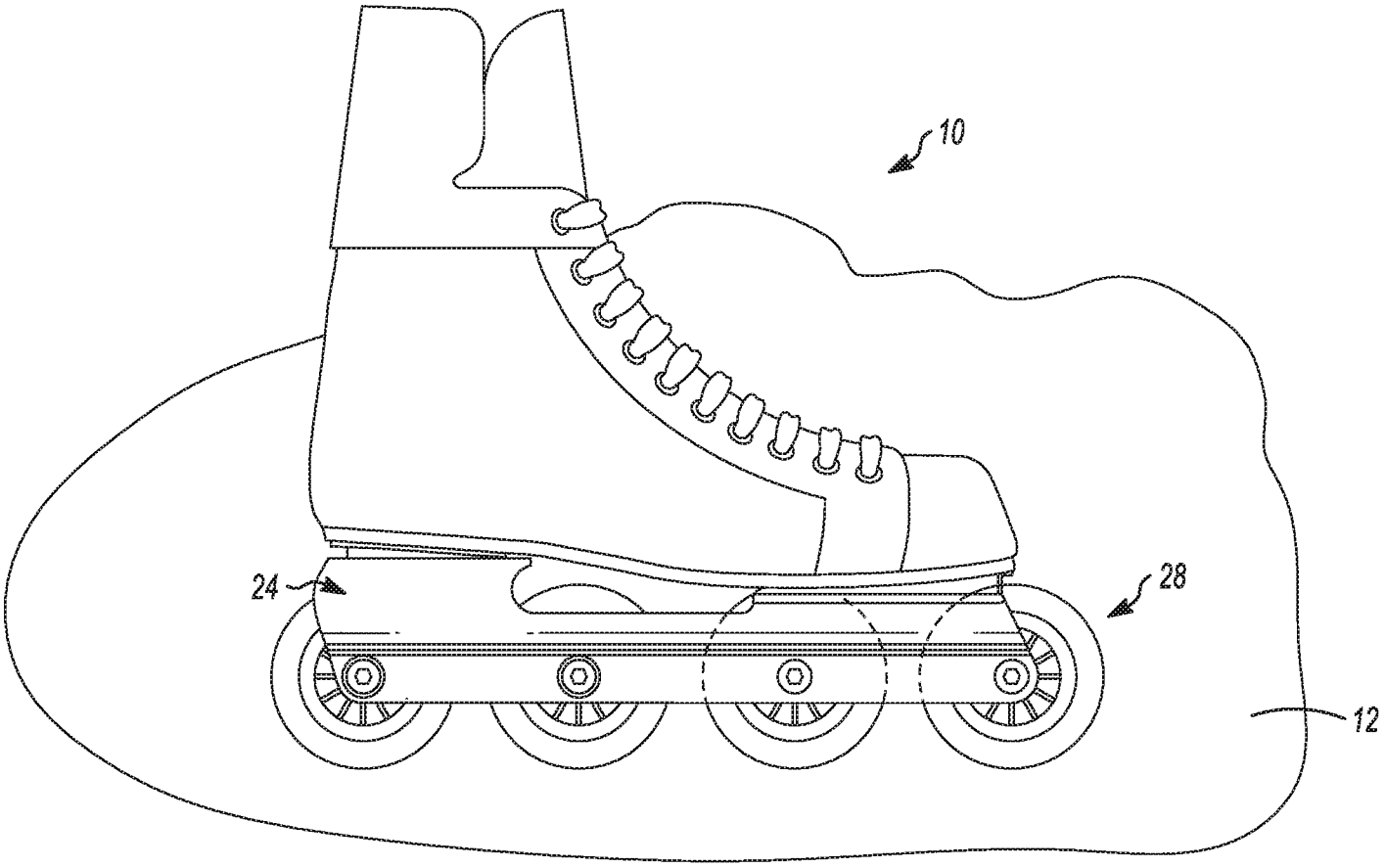
FIG. 46 is an example of a variant of footwear in which the footwear is an inline skate.

Although in embodiments considered above the skate 10 is designed for playing ice hockey on the skating surface 12 which is ice, in other embodiments, the skate 10 may be constructed using principles described herein for playing roller hockey or another type of hockey (e.g., field or street hockey) on the skating surface 12 which is a dry surface (e.g., a polymeric, concrete, wooden, or turf playing surface or any other dry surface on which roller hockey or field or street hockey is played). Thus, in other embodiments, instead of comprising the blade 26, the skating device 28 may comprise a wheel holder holding a set of wheels to roll on the dry skating surface 12 (i.e., the skate 10 may be an inline skate or other roller skate). The wheel holder may be constructed using principles discussed herein in respect of the blade holder 24. For example, as shown in FIG. 46, the footwear is an inline skate. Moreover, in other embodiments, the skate 10 may be a figure skate constructed using principles described herein for figure skating.

Figure 44:
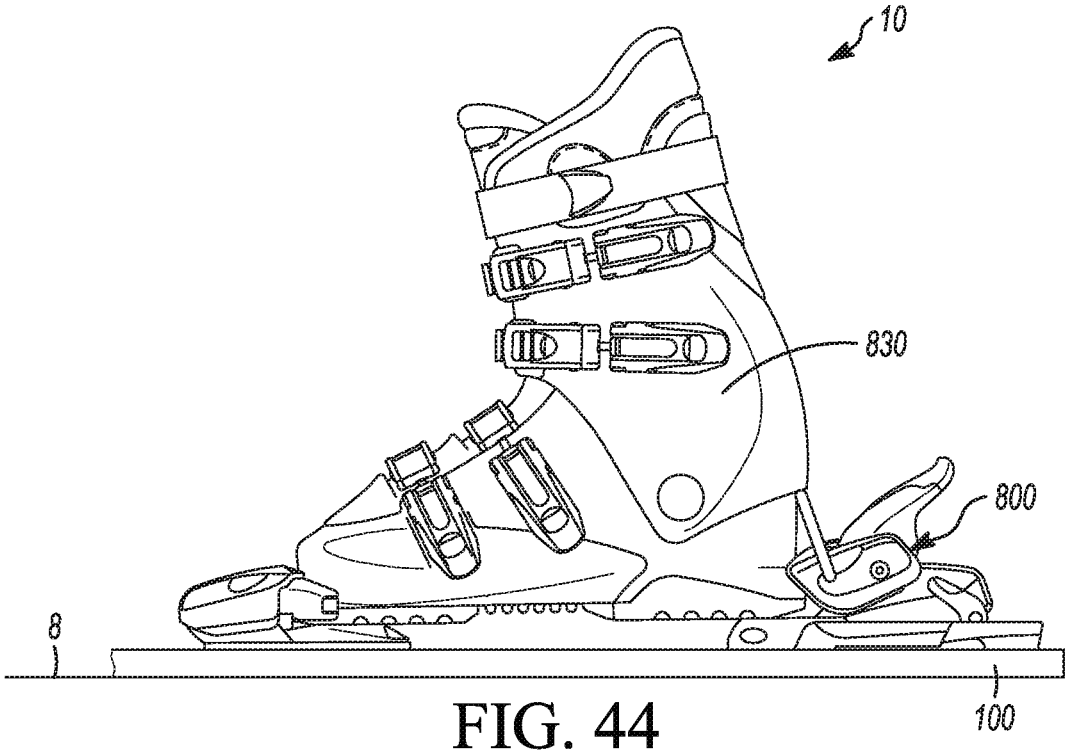
FIG. 44 is an example of a variant of footwear in which the footwear is a ski boot.
Figure 45:
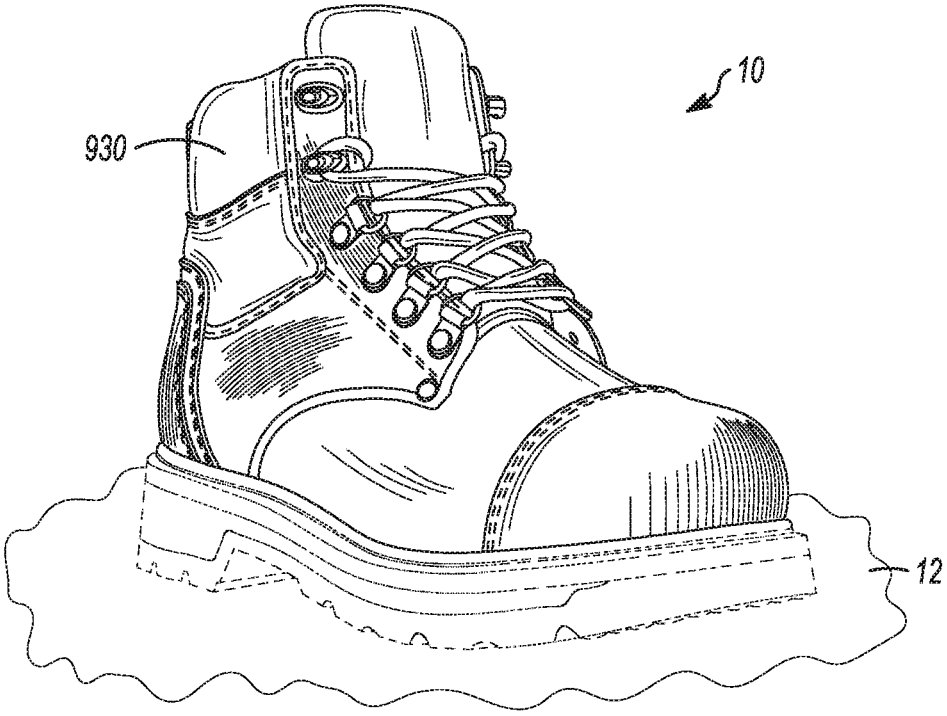
FIG. 45 is an example of a variant of footwear in which the footwear is a work boot.
Figure 47:
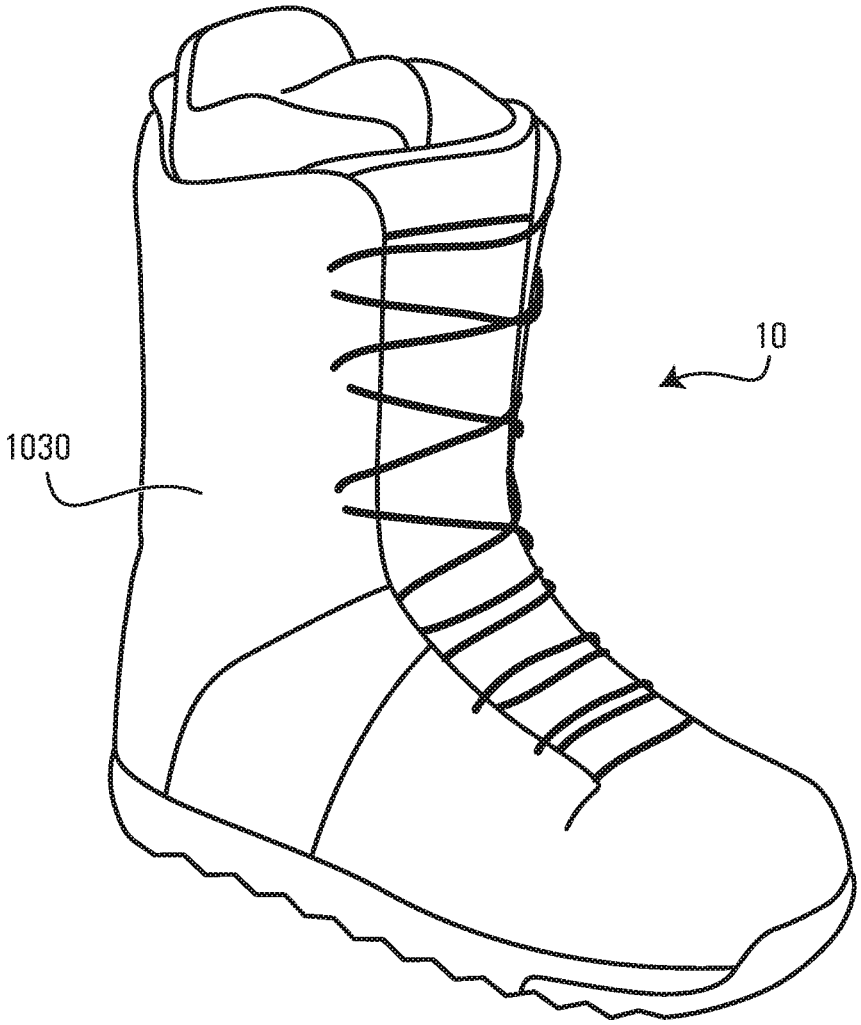
FIG. 47 is an example of a variant of footwear in which the footwear is a snowboard boot.
Figure 48:
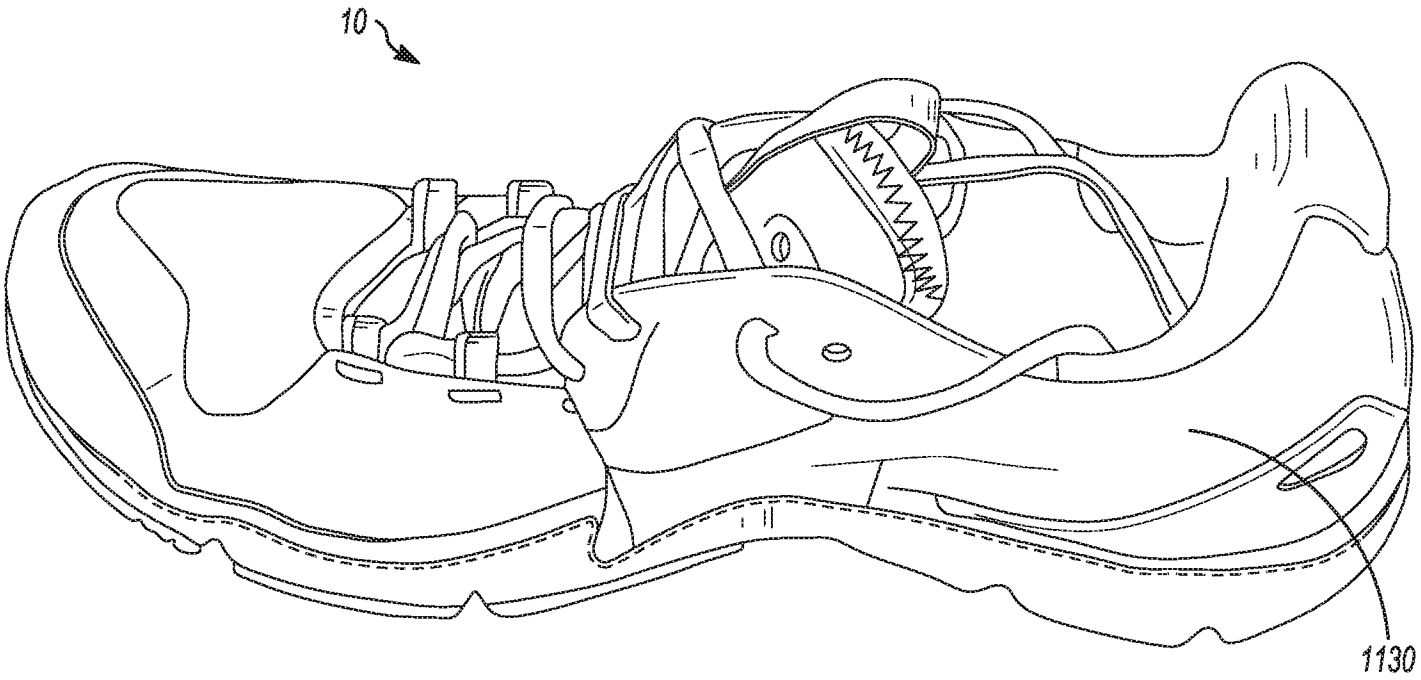
FIG. 48 is an example of a variant of footwear in which the footwear is a sport shoe.

Furthermore, although in embodiments considered above the footwear 10 is a skate for skating on the skating surface 12, in other embodiments, the footwear 10 may be any other suitable type of footwear. For example, as shown in FIG. 44, the footwear 10 may be a ski boot comprising a shell 830 which may be constructed in the manner described above with respect to the shell of the skate. In particular, the ski boot 10 is configured to be attachable and detachable from a ski 802 which is configured to travel on a ground surface 8 (e.g., snow). To that end, the ski boot 10 is configured to interact with an attachment mechanism 800 of the ski 802. In another example, as shown in FIG. 45, the footwear 10 may be a boot (e.g., a work boot or any other type of boot) comprising a shell 930 which can be constructed in the manner described above with respect to the shell of the skate. In another example, as shown in FIG. 47, the footwear 10 may be a snowboard boot comprising a shell 1030 which can be constructed in the manner described above with respect to the shell of the skate. In another example, as shown in FIG. 48, the footwear 10 may be a sport shoe comprising a body 1130 which can be constructed in the manner described above with respect to the shell of the skate.

In some embodiments, any feature of any embodiment described herein may be used in combination with any feature of any other embodiment described herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

In case of any discrepancy, inconsistency, or other difference between terms used herein and terms used in any document incorporated by reference herein, meanings of the terms used herein are to prevail and be used.

Although various embodiments have been illustrated, this was purposes of describing, but should not be limiting. Various modifications will become apparent to those skilled in the art.

The invention claimed is:

1. A skate boot for a user to skate, the skate boot being configured to receive a foot of the user above a skating device engaging a skating surface, the skate boot comprising:

a shell comprising a lateral side portion configured to face a lateral side of the user's foot, a medial side portion configured to face a medial side of the user's foot, a heel portion configured to face a heel of the user's foot, an ankle portion configured to face an ankle of the user, and a sole portion configured to face a plantar surface of the user's foot; and an outsole disposed between the sole portion of the shell and the skating device, mounted to the sole portion of the shell, and comprising a plurality of materials that are different and positioned differently in a longitudinal direction of the outsole.

2. The skate boot of claim 1, wherein: a first one of the materials of the outsole is positioned in a front portion of the outsole and configured to be beneath toes and a ball of the user's foot; and a second one of the materials of the outsole is positioned in a rear portion of the outsole, configured to be disposed beneath the heel of the user's foot, and more resilient than the first one of the materials of the outsole.

3. The skate boot of claim 2, wherein the second one of the materials of the outsole is configured to resiliently deform for allowing the heel portion of the shell to move relative to the skating device while the user skates.

4. The skate boot of claim 3, wherein the outsole is configured to prevent rotation of the heel portion of the shell relative to the skating device about a lateral axis of the skate boot.

5. The skate boot of claim 3, wherein the second one of the materials of the outsole is configured to resiliently compress for allowing the heel portion of the shell to move relative to the skating device while the user skates.

6. The skate boot of claim 3, wherein the second one of the materials of the outsole is configured to resiliently deform for allowing the heel portion of the shell to move laterally relative to the skating device while the user skates.

7. The skate boot of claim 2, wherein the second one of the materials of the outsole is configured to resiliently deform for allowing movement of the heel portion of the shell relative to the skating device while the user skates.

8. The skate boot of claim 7, wherein the second one of the materials of the outsole is configured to resiliently compress for allowing movement of the heel portion of the shell relative to the skating device while the user skates.

9. The skate boot of claim 7, wherein the movement of the heel portion of the shell relative to the skating device includes at least one of: rotation of the heel portion of shell relative to the skating device about a longitudinal axis of the skate boot; and translation of the heel portion of the shell relative to the skating device in a widthwise direction of the skate boot.

10. The skate boot of claim 2, wherein: the first one of the materials of the outsole is configured to facilitate the user skating straight; and the second one of the materials of the outsole is configured to facilitate the user turning.

11. The skate boot of claim 2, wherein: the first one of the materials of the outsole is configured to facilitate push-off and power transfer by the user while skating; and the second one of the materials of the outsole is configured to facilitate turns by the user while skating.

12. The skate boot of claim 2, wherein: the first one of the materials of the outsole is configured to transfer more power to the skating device while the user skates in a given direction than the second one of the materials of the outsole.

13. The skate boot of claim 2, wherein a hardness of the second one of the materials of the outsole is lower than a hardness of the first one of the materials of the outsole.

14. The skate boot of claim 2, wherein a modulus of elasticity of the second one of the materials of the outsole is lower than a modulus of elasticity of the first one of the materials of the outsole.

15. The skate boot of claim 2, wherein the first one of the materials of the outsole is composite material and the second one of the materials of the outsole is non-composite material.

16. The skate boot of claim 15, wherein the non-composite material is elastomeric material.

17. The skate boot of claim 2, wherein: the first one of the materials of the outsole is fiber-reinforced polymeric material; and the second one of the materials of the outsole is polymeric material without reinforcing fibers.

18. The skate boot of claim 17, wherein the polymeric material without reinforcing fibers is elastomeric material.

19. The skate boot of claim 2, wherein a third one of the materials of the outsole is disposed between the first one of the materials of the outsole and the second one of the materials of the outsole.

20. The skate boot of claim 19, wherein the third one of the materials of the outsole is also disposed at a rear end part of the outsole.

21. The skate boot of claim 19, wherein the third one of the materials of the outsole is less stiff than the first one of the materials of the outsole and stiffer than the second one of the materials of the outsole.

22. The skate boot of claim 19, wherein the third one of the materials of the outsole is non-elastomeric.

23. The skate boot of claim 19, wherein the third one of the materials of the outsole is polymeric material without reinforcing fibers.

24. The skate boot of claim 2, wherein the rear portion of the outsole comprises a lateral part and a medial part that include the second one of the materials of the outsole and are spaced in a widthwise direction of the outsole.

25. The skate boot of claim 24, wherein the rear portion of the outsole comprises a gap free of the second one of the materials of the outsole between the lateral part and the medial part of the rear portion of the outsole.

26. The skate boot of claim 2, wherein the rear portion of the outsole comprises a frame supporting the second one of the materials of the outsole and connected to the front portion of the outsole.

27. The skate boot of claim 26, wherein the frame includes a third one of the materials of the outsole that is stiffer than the second one of the materials of the outsole.

28. The skate boot of claim 27, wherein the third one of the materials of the outsole is non-elastomeric.

29. The skate boot of claim 27, wherein the rear portion of the outsole comprises a lateral part and a medial part that include the second one of the materials of the outsole, are spaced in a widthwise direction of the outsole, and are interconnected by the frame.

30. The skate boot of claim 29, wherein the rear portion of the outsole comprises a gap free of the second one of the materials of the outsole between the lateral part and the medial part of the rear portion of the outsole.

31. The skate boot of claim 26, wherein the frame comprises a rear end element disposed at a rear end part of the outsole and including the third one of the materials of the outsole.

32. The skate boot of claim 26, wherein the frame comprises fabric.

33. The skate boot of claim 1, wherein the materials of the outsole include at least three materials.

34. The skate boot of claim 1, wherein: the skate is an ice skate, the skating surface is ice; and the skating device comprises a blade holder and a blade held by the blade holder.

35. A skate boot for a user to skate, the skate boot being configured to receive a foot of the user above a skating device engaging a skating surface, the skate boot comprising:

a shell comprising a lateral side portion configured to face a lateral side of the user's foot, a medial side portion configured to face a medial side of the user's foot, a heel portion configured to face a heel of the user's foot, an ankle portion configured to face an ankle of the user, and a sole portion configured to face a plantar surface of the user's foot; and an outsole disposed between the sole portion of the shell and the skating device, mounted to the sole portion of the shell, and comprising: a first material positioned in a front portion of the outsole and configured to be beneath toes and a ball of the user's foot; and a second material positioned in a rear portion of the outsole, configured to be disposed beneath the heel of the user's foot, and more resilient than the first material.

36. A skate boot for a user to skate, the skate boot being configured to receive a foot of the user above a skating device engaging a skating surface, the skate boot comprising:

a shell comprising a lateral side portion configured to face a lateral side of the user's foot, a medial side portion configured to face a medial side of the user's foot, a heel portion configured to face a heel of the user's foot, an ankle portion configured to face an ankle of the user, and a sole portion configured to face a planter surface of the user's foot; and an outsole disposed between the sole portion of the shell and the skating device, mounted to the sole portion of the shell, and comprising: a first material positioned in a front portion of the outsole and configured to be beneath toes and a ball of the user's foot; and a second material different from the first material, positioned in a rear portion of the outsole, configured to be disposed beneath the heel of the user's foot, and configured to resiliently deform for allowing the heel portion of the upper of the skate boot to move relative to the skating device while the user skates.

* * * * *